US008695347B2

(12) United States Patent
Hatamiya et al.

(10) Patent No.: US 8,695,347 B2
(45) Date of Patent: Apr. 15, 2014

(54) POWER PLANT

(75) Inventors: Shigeo Hatamiya, Hitachi (JP); Koji Namba, Mito (JP); Fumio Takahashi, Hitachi (JP); Koji Nishida, Hitachiota (JP); Susumu Nakano, Hitachi (JP); Takanori Shibata, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 166 days.

(21) Appl. No.: 13/146,672

(22) PCT Filed: Jan. 19, 2010

(86) PCT No.: PCT/JP2010/000248

§ 371 (c)(1),
(2), (4) Date: Jul. 28, 2011

(87) PCT Pub. No.: WO2010/087126

PCT Pub. Date: Aug. 5, 2010

(65) Prior Publication Data

US 2011/0283704 A1 Nov. 24, 2011

(30) Foreign Application Priority Data

Jan. 30, 2009 (JP) ..... 2009-018876

(51) Int. Cl.
*F01K 7/34* (2006.01)
*F01K 13/02* (2006.01)

(52) U.S. Cl.
USPC ..... 60/678; 60/677; 60/652

(58) Field of Classification Search
USPC ..... 60/645–681
See application file for complete search history.

(56) References Cited

U.S. PATENT DOCUMENTS 3,842,605 A * 10/1974 Tegtmeyer ..... 60/678
4,047,386 A * 9/1977 Frondorf ..... 60/654
4,748,815 A * 6/1988 Junior et al. ..... 60/692
8,091,361 B1 * 1/2012 Lang ..... 60/654

FOREIGN PATENT DOCUMENTS

| | | | |
|---|---|---|---|
| JP | 54-162044 A | | 12/1979 |
| JP | 57-212308 A | | 12/1982 |
| JP | 57212308 A | * | 12/1982 |
| JP | 59-93103 A | | 5/1984 |
| JP | 59093103 A | * | 5/1984 |
| JP | 1-123001 U | | 8/1989 |
| JP | 2-42103 A | | 2/1990 |
| JP | 5-65808 A | | 3/1993 |

OTHER PUBLICATIONS

International Search Report dated Mar. 23, 2010 including English-language translation (Five (5) pages).

* cited by examiner

*Primary Examiner* — Thomas Denion
*Assistant Examiner* — Laert Dounis
(74) *Attorney, Agent, or Firm* — Crowell & Moring LLP

(57) ABSTRACT

A boiling water nuclear power plant supplies steam from a reactor to high-pressure and low-pressure turbines. Feed water generated by condensing steam in a condenser is heated by low-pressure and high-pressure feed water heaters and supplied to the reactor. The steam discharged from the low-pressure turbine is compressed by a steam compressor and supplied to one of the low-pressure feed water heaters to heat feed water. The steam extracted from the low-pressure turbine is supplied to the low-pressure feed water heater. When power required for the steam compressor is Q1, heat energy supplied from the steam compressor is Q3, a coefficient of performance of the steam compressor is COP (=Q3/Q1), and a thermal efficiency of the boiling water nuclear power plant is $\eta$, the steam compression apparatus is connected to a position in a main steam system and to the feed water heater so as to satisfy $COP-1/\eta>0$.

14 Claims, 11 Drawing Sheets

POWER PLANT

BACKGROUND OF THE INVENTION

1. Technical Field

The present invention relates to power plants, and more particularly, to a power plant suitable for application to a nuclear power plant and a thermal power plant.

2. Background Art

For the purpose of increasing the thermal efficiency of a plant, a thermal power plant that employs a steam heat pump using a steam compressor has been proposed. An example of this thermal power plant is described in Japanese Utility Model Laid-Open No. 1 (1989)-123001. The proposed thermal power plant supplies sequentially steam generated in a boiler to a high-pressure turbine, a medium-pressure turbine, and a low-pressure turbine and generates power by rotating a generator coupled to the rotational axis of these turbines. The steam discharged from the low-pressure turbine becomes water by being condensed in a condenser. This water is supplied to a boiler as feed water through a feed water pipe. The feed water is heated by four stages of feed water heaters to increase its temperature as it passes through the feed water pipe. The steam extracted from the condenser is compressed by a compressor and a temperature of the stream is increased by the compression. The compressed steam is extracted at a plurality of points in the axial direction of the compressor to be supplied to each of the feed water heaters. The feed water is heated by the compressed steam supplied to each feed water heater. The steam becomes condensate water in each feed water heater and the condensate water is supplied to the feed water. Additionally, since the steam compressor, whose internal enthalpy is increased by adiabatic compression of the steam, becomes an overheated condition, a mist of the condensed water is sprayed inside the compressor to prevent such condition and to save necessary power.

In addition, Japanese Patent Laid-Open No. 5 (1993)-65808 discloses a thermal cogeneration steam turbine plant.

In this thermal cogeneration steam turbine plant, steam generated in a boiler is supplied to a turbine to rotate a generator for power generation, and steam discharged from the turbine is supplied to each of high-pressure and low-pressure processing steam supply facilities. The high-pressure processing steam supply facility is supplied with the steam discharged from the turbine, compressed by a compressor.

CITATION LIST

Patent Literature

Patent literature 1: Japanese Utility Model Laid-Open No. 1 (1989)-123001

Patent literature 2: Japanese Patent Laid-Open No. 5 (1993)-65808

SUMMARY OF THE INVENTION

Technical Problem

SO as to converts low-temperature steam into high-temperature steam by a steam compressor, work in the steam compressor is certainly required. As in the thermal power plant described in Japanese Utility Model Laid-Open No. 1 (1989)-123001, when low-temperature steam is compressed into high-temperature steam by the steam compressor so that the high-temperature steam can be used for heating feed water, if the work required for the steam compressor is larger than the power increase obtained by introducing the steam compressor, there is no net power uprating and no efficiency improvement in the plant.

In particular, when the power is uprated in a power plant, the thermal efficiency of the power plant decreases; thus a way to prevent the decrease in the thermal efficiency of the power plant during power uprating is necessary. This may be solved by increasing the temperature of feed water.

The inventors have studied ways to use a steam compressor to improve the thermal efficiency of a power plant using a steam generation apparatus, when steam extracted from a main steam system of the power plant is compressed by the steam compressor and the compressed and temperature-increased steam is used to heat feed water supplied to the steam generation apparatus. In particular, in a power plant, power uprating which uprates the power more than a rated power of 100% has been considered.

It is an object of the present invention to provide a power plant that can improve thermal efficiency of a plant in power uprating.

Solution to Problem

To achieve the above object, the present invention is provided with a main steam system having a main steam pipe for introducing steam and connected to a steam generation apparatus, and a first turbine and a second turbine having a lower pressure than the first turbine to which turbines, the steam is sequentially supplied through the main steam pipe; a condenser for condensing the steam discharged from the second turbine; a feed water pipe for introducing feed water generated by condensing the steam in the condenser to the steam generation apparatus; a plurality of feed water heaters provided to the feed water pipe; a steam compression apparatus for compressing the steam; a first pipe, not provided with the steam compression apparatus, for introducing the steam extracted from a first position of the main steam system to one of the feed water heaters; and a second pipe provided with the steam compression apparatus, for connecting a second position of the main steam system located downstream of the first position to the one feed water heater connected with the first pipe, wherein, when power required for compressing the steam by the steam compression apparatus is Q1, heat quantity supplied to the one feed water heater by the steam compressed by the steam compression apparatus is Q3, coefficient of performance of the steam compression apparatus, defined as Q3/Q1, is COP, and thermal efficiency of a power plant supplying the power Q1 to the steam compression apparatus is $\eta$, the second pipe provided with the steam compression apparatus is connected to the second position and one feed water heater so as to satisfy $COP-1/\eta>0$.

Since the second pipe provided with the steam compression apparatus is connected to the second position and one feed water heater so as to satisfy $COP-1/\eta>0$, the thermal efficiency of the power plant can be improved.

Therefore, the thermal efficiency of the plant can be improved during power uprating of the power plant.

Advantageous Effect of the Invention

According to the present invention, the thermal efficiency of the plant can be improved in power uprating.

DETAILED DESCRIPTION OF THE PREFERRED EMBODIMENTS

The inventors have closely studied the thermal power plant described in Japanese Utility Model Laid-Open No. 1 (1989)-123001. As a result, the inventors have found out, as described above, a problem in the thermal power plant such as since a compressor becomes enlarged, the electric energy consumed in the compressor is increased. As for the electric power, the power generated in the thermal power plant, which is provided with the compressor, is used so that large power consumption in the compressor consequently decreases the efficiency of the thermal power plant.

The inventors have conducted various studies to find out a solution for this problem. As a result, the inventors have found out that the above problem can be solved by a following idea (hereinafter, referred to as the improved idea): that is, in a power plant such as a thermal power plant, while steam extracted from a steam system such as a turbine is supplied to a feed water heater for heating feed water, this feed water heater is supplied also with steam supplied from a point downstream from the extraction point of the above steam, and compressed in a compressor. This improved idea shows one concept of the present invention. In the improved idea, steam compressed by a compressor is supplied to a feed water heater for heating feed water while steam extracted from a steam system such as a turbine is supplied to the feed water heater without passing through the compressor, thus a range of an increase in the temperature of the steam increased by compression of the compressor can be less than that of the steam increased by compression of the compressor required in the thermal power plant described in Japanese Utility Model Laid-Open No. Hei 1 (1989)-123001. The auxiliary power consumed by the operation of the compressor in the power plant according to the improved idea is less than the auxiliary power consumed by the operation of the compressor in the power plant according to Japanese Utility Model Laid-Open No. 1 (1989)-123001. Consequently, the thermal efficiency of the plant in the power plant according to the improved idea is improved.

In addition, in the studies done by the inventors, it has become evident that the thermal efficiency of the power plant is improved when $COP-1/\eta>0$ is satisfied. Here, COP (coefficient of Performance) is a coefficient of performance for a steam heat pump having a compressor for compressing steam, and $\eta$ is a thermal efficiency of a power generation system for supplying power to a motor for driving the steam heat pump. The coefficient of performance COP of the steam heat pump is defined as Q3/Q1 using Q1 as the power required for the steam heat pump and Q3 as the heat quantity supplied from the steam heat pump for heating feed water.

Thermodynamic cycles in a conventional power plant and a power plant according to the improved idea will be described with reference to FIG. 4.

Figure 4:
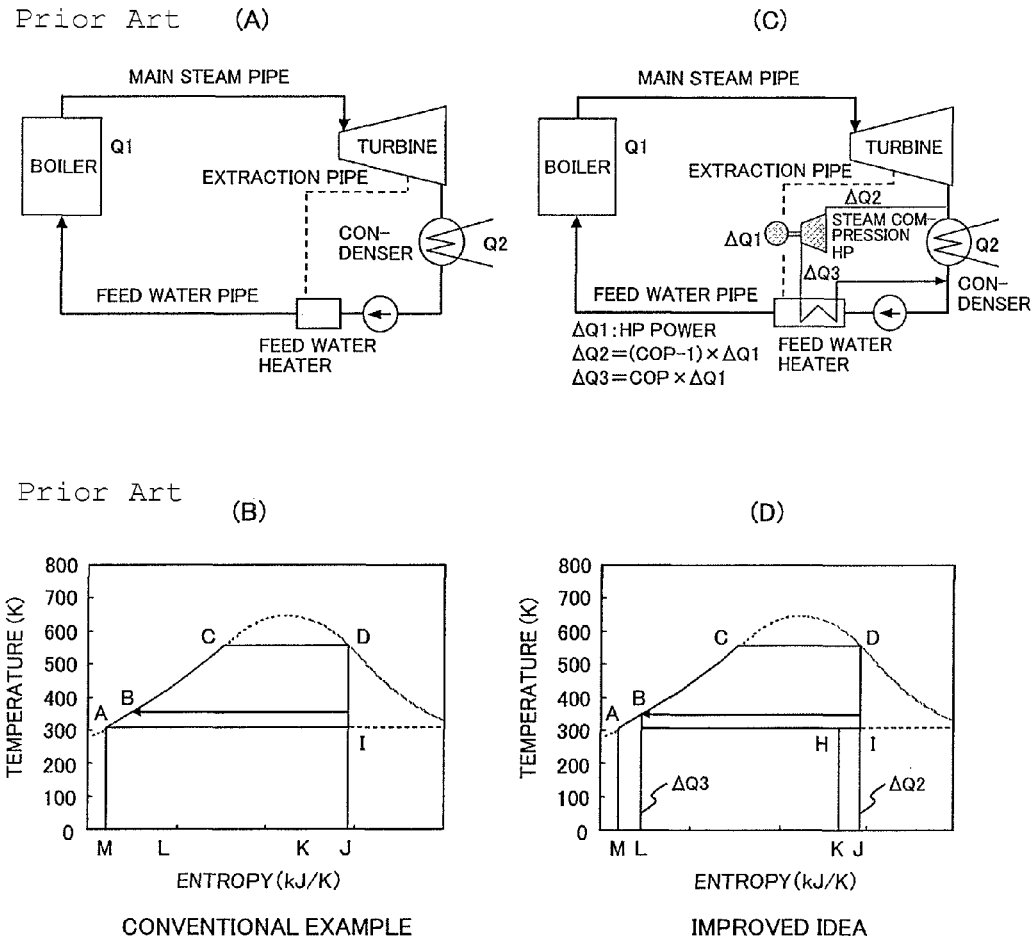
FIG. 4 is an explanatory drawing showing a thermodynamic cycle in a power plant where (A) is a schematic structural view showing a conventional power plant, (B) is a T-S diagram for the conventional power plant shown in (A), (C) is a schematic structural view showing a power plant according to an improved idea showing one summary of the present invention, and (D) is a T-S diagram for the power plant according to the improved idea shown in (C).

(A) of FIG. 4 shows a schematic structure of the conventional power plant without a compressor. Steam generated in a boiler (a steam generation apparatus) is supplied to a turbine through a main steam pipe. The steam discharged from the turbine is condensed in a condenser and becomes water. This water is supplied to the boiler as feed water through a feed water pipe. The feed water is heated by extraction steam extracted from the turbine, supplied to the feed water pipe.

(B) of FIG. 4 shows a T-S diagram for the conventional power plant shown in the (A) of FIG. 4. Here, T is temperature and S is entropy. An entropy S is obtained by multiplying a normally-used specific entropy by a flow rate G. An input heat quantity from the boiler (the steam generation apparatus) is designated by Q1 and a released heat quantity from the condenser is designated by Q2. The input heat quantity Q1 is expressed in terms of an area ABCDIJKLMA and the released heat quantity Q2 is expressed in terms of an area AIJKLMA. Work L in the turbine is L=Q1−Q2, corresponding to the area ABCDIA. The thermal efficiency $\eta$ of the power plant can be calculated by $\eta=L/Q1$ (C) of FIG. 4 shows the schematic structure of a power plant with a compressor according to the improved idea. The power plant according to the improved idea has a structure in which a compressor is added to the conventional power plant. In the power plant according to the improved idea, the steam discharged from the turbine is compressed by the compressor, and the compressed steam is supplied to a feed water heater supplied with extraction steam. The feed water to be supplied to the boiler is heated by the extraction steam and the compressed steam.

(D) of FIG. 4 shows a T-S diagram for the power plant according to the improved idea shown in the (C) of FIG. 4. In the improved idea also, an input heat quantity from the boiler to the turbine is designated by Q1*i* (not shown) and a released heat quantity from the condenser is designated by Q2*i* (not shown). Since the energy ΔQ3 is given by the feed water heater in the improved idea, when steam generation rates in the conventional power plant (the (A) of FIG. 4) and the power plant of the improved idea (the (C) of FIG. 4) are the same, Q1*i*=Q1−ΔQ3 and Q2*i*=Q2−ΔQ2.

When ΔQ1 is shaft power of the steam heat pump having the compressor, the following relations are formed between the power of the steam heat pump and the energy supplied from the steam heat pump for heating feed water though the coefficient of performance COP.

$$\Delta Q3=\mathrm{COP}\times\Delta Q1 \quad (1)$$

$$\Delta Q2=(\mathrm{COP}-1)\times\Delta Q1 \quad (2)$$

Work Li in the turbine according to the improved idea is Li=Q1*i*−Q2*i* and the thermal efficiency ηi of the power plant according to the improved idea can be calculated by ηi=Li/Q1*i*.

The net work Li in the power plant according to the improved idea can be expressed in terms of a relationship in equation (3) where the power ΔQ1 required for the compressor is subtracted from the work L in the turbine in the conventional power plant (the (A) of FIG. 4).

$$Li=L-\Delta Q1 \quad (3)$$

Since Q1*i*=Q1−COP×ΔQ1, the thermal efficiency ηi of the power plant according to the improved idea can be expressed by equation (4).

$$\eta i=(L-\Delta Q1)/(Q1-\mathrm{COP}\times\Delta Q1) \quad (4)$$

Since L=ηQ1, the equation (4) can be arranged as in equation (5).

$$\eta i/\eta\approx 1+(\Delta Q1/Q1)\times(\mathrm{COP}-1/\eta) \quad (5)$$

In the equation (5), when the second term of the right side is positive, the left side is greater than 1. Therefore, the thermal efficiency of the power plant according to the improved idea is higher than the thermal efficiency of the conventional power plant shown in the (A) of FIG. 4.

To be more specific, when the thermal efficiency η of the plant is 0.334, for example, if the compressor of the steam heat pump is connected to a steam extraction point of the main steam system and to a feed water heater of the feed water system in the power plant so as to satisfy COP>3, the thermal efficiency of the power plant can be improved compared to the conventional power plant shown in the (A) of FIG. 4. Tables 1 to 6 to be given later show some steam extraction points to be connected with the steam compressor of the steam heat pump and feed water heaters to be supplied with the steam compressed by the steam compressor, which satisfy COP>3. The thermal efficiency of the power plant is improved when the steam compressor is connected as in each state having a good evaluation mark (a mark o) in the "evaluation" column in these charts.

A degree of improvement in the thermal efficiency of the power plant according to the improved idea was calculated based on the equation (5) using an example of a BWR-5 type boiling water nuclear power plant generating an electric power of 1100 MWe. The thermal power Q1 of this boiling water nuclear power plant is 3300 MWt and the shaft power ΔQ1 of the compressor of the steam heat pump is 33.5 MWt. When the steam extracted from the main steam system of the boiling water nuclear power plant, having a steam temperature T of 100° C., is compressed by the compressor of the steam heat pump until it becomes 160° C., the coefficient of performance COP of the steam heat pump is approximately 6. Since the nominal value of the thermal efficiency η of a conventional BWR-5 type boiling water nuclear power plant, generating an electric power of 1100 MWe, is 0.334, the increase rate of the thermal efficiency of the plant at a coefficient of performance COP of 6 is ηi/η=1.0305. This means that, using the steam heat pump in the above condition increases the thermal efficiency by approximately 3% in terms of a relative value and approximately 1% in terms of an absolute value.

Various embodiments of the present invention that are achieved based on the above-described improved idea will be explained below.

Embodiment 1

A power plant according to embodiment 1, which is a preferred embodiment of the present invention, will be described with reference to FIG. 1. The power plant of the present embodiment is a BWR-5 type boiling water nuclear power plant 1, generating an electric power of 1100 MWe.

The boiling water nuclear power plant 1 is provided with a reactor 2, which is a steam generation apparatus, a high-pressure turbine (a first turbine) 3, low-pressure turbines (second turbines) 5A, 5B and 5C, a main steam pipe 6, a condenser 11, a plurality of feed water heaters, a feed water pipe 15, and a steam compression apparatus 27. These feed water heaters include a first high-pressure feed water heater 16A, a second high-pressure feed water heater 16B, a third low-pressure feed water heater (a first low-pressure feed water heater) 17A, a fourth low-pressure feed water heater (a second low-pressure feed water heater) 17B, a fifth low-pressure feed water heater (a third low-pressure feed water heater) 17C, and a sixth low-pressure feed water heater (a fourth low-pressure feed water heater) 17D. The low-pressure feed water heaters are a feed water heater to which the extraction steam from the low-pressure turbine is supplied. The high-pressure feed water heaters are a feed water heater to which extraction steam from the high-pressure turbine (or the main steam pipe 6 in the exit side of the high-pressure turbine 3) is supplied. The high-pressure turbine 3 and the low-pressure turbines 5A, 5B, and 5C are connected to the reactor 2 through the main steam pipe 6. A moisture separator (a moisture separation apparatus) 4 is installed to the main steam pipe 6 connecting the high-pressure turbine 3 and the low-pressure turbines 5A, 5B, and 5C. The high-pressure turbine 3 and the low-pressure turbines 5A, 5B, and 5C are mutually linked by one rotating shaft 10, which is further linked to a generator 9. The present embodiment is provided with one high-pressure turbine and three low-pressure turbines, but the numbers may vary according to the type of power plant.

The present embodiment has a main steam system and a feed water system. The main steam system has the high-pressure turbine 3, the moisture separator 4, the low-pressure turbines 5A, 5B, and 5C, the main steam pipe 6, and the condenser 11. The feed water system has the feed water pipe 15, the first high-pressure feed water heater 16A, the second high-pressure feed water heater 16B, the third low-pressure feed water heater 17A, the fourth low-pressure feed water heater 17B, the fifth low-pressure feed water heater 17C, the sixth low-pressure feed water heater 17D, and a feed water pump 19.

The condenser 11 has a plurality of heat exchanger tubes 12 disposed inside. These heat exchanger tubes 12 are connected to a seawater pipe 13. A seawater circulation pump (not shown) is installed to the seawater pipe 13. Both ends of the seawater pipe 13 reach the ocean.

The feed water pipe 15 connects the condenser 11 and the reactor 2. The first high-pressure feed water heater 16A, the second high-pressure feed water heater 16B, the third low-pressure feed water heater 17A, the fourth low-pressure feed water heater 17B, the fifth low-pressure feed water heater 17C, and the sixth low-pressure feed water heater 17D are installed to the feed water pipe 15 in this order from the reactor 2 toward the condenser 11. A condensate pump 18 is provided to the feed water pipe 15 between the condenser 11 and the sixth low-pressure feed water heater 17D. The feed water pump 19 is provided to the feed water pipe 15 between the first high-pressure feed water heater 16A and the second high-pressure feed water heater 16B.

An extraction pipe 20 connected with the high-pressure turbine 3 at an extraction point 50 is connected to the first high-pressure feed water heater 16A. An extraction pipe 21 connected with the high-pressure turbine 3 at an extraction point 51 is connected to the second high-pressure feed water heater 16B. The extraction pipe 21 is connected to the high-pressure turbine 3 downstream of the last stage of rotor blades of the high-pressure turbine 3, and the extraction point 51 is in a later stage than the extraction point 50. An extraction pipe 22 connected with the low-pressure turbine 5B is connected to the third low-pressure feed water heater 17A. A drainpipe 26 connected with the moisture separator 4 is connected to the third low-pressure feed water heater 17A. An extraction pipe 23 connected with the low-pressure turbine 5B at an extraction point 53 is connected to the fourth low-pressure feed water heater 17B. An extraction pipe 24 connected with the low-pressure turbine 5B at an extraction point 54 is connected to the fifth low-pressure feed water heater 17C. An extraction pipe 25 connected with the low-pressure turbine 5B is connected to the sixth low-pressure feed water heater 17D. The extraction points 52, 53, 54, and 55 are provided in this order from the steam inlet of the low-pressure turbine 5B toward the steam outlet of the low-pressure turbine 5B in the axial direction of the low-pressure turbine. These extraction points are provided to a turbine casing (not shown) of the low-pressure turbine 5B at different stages of a plurality of stationary blades provided to the low-pressure turbine 5B. A drain water recovery pipe 34 connecting the first high-pressure feed water heater 16A, the second high-pressure feed water heater 16B, the third low-pressure feed water heater 17A, the fourth low-pressure feed water heater 17B, the fifth low-pressure feed water heater 17C, and the sixth low-pressure feed water heater 17D is connected to the feed water pipe 15 upstream of the condensate pump 18.

Figure 1:
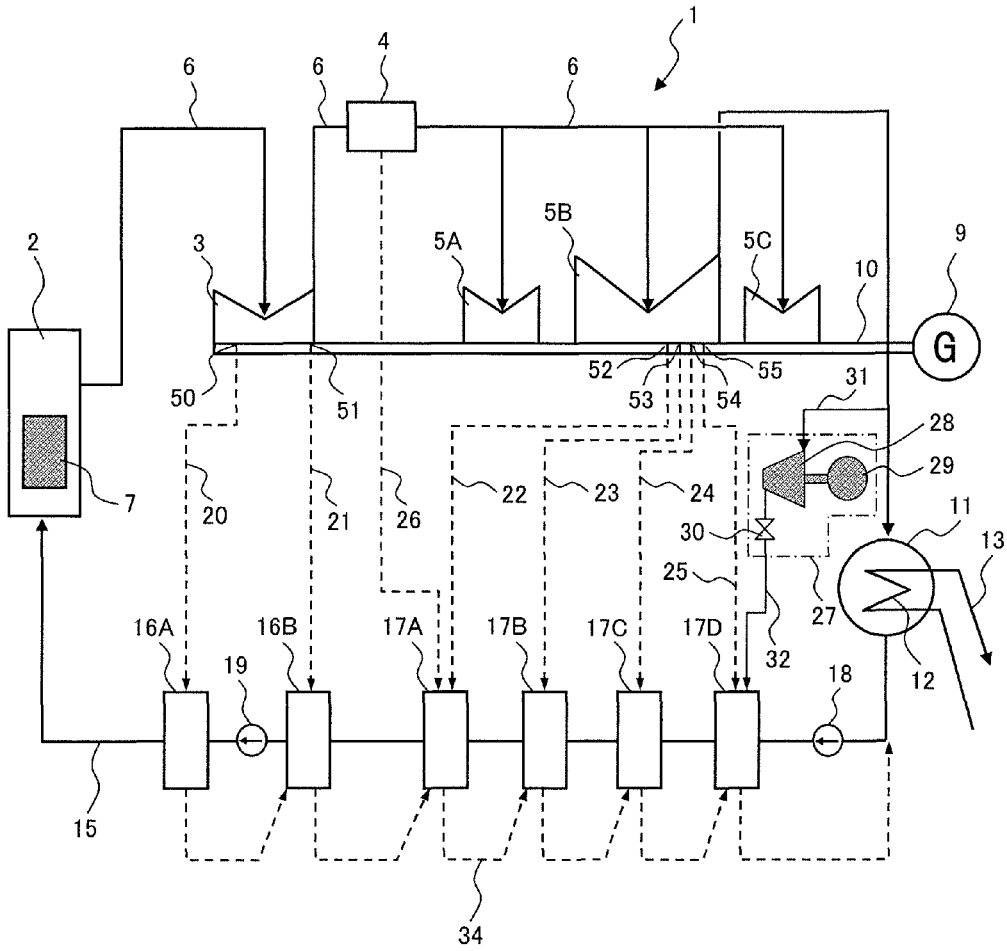
FIG. 1 is a structural diagram showing a power plant according to embodiment 1, which is a preferred embodiment of the present invention, applied to a boiling water nuclear power plant.

FIG. 1 shows the low-pressure turbine 5B large and the low-pressure turbines 5A and 5C small, but the size of these low-pressure turbines is the same. Although not shown in the figure, the low-pressure turbines 5A and 5C, also, are each provided with the condenser 11, and each condenser 11 is connected to the respective feed water pipe 15. The total of three condensers 11 provided to the low-pressure turbines 5A, 5B, and 5C respectively have three feed water pipes 15 connected to them respectively, which pipes come together at a joining point located upstream of the second high-pressure feed water heater 16B. The three feed water pipes 15 become a single feed water pipe 15 after joining together at the joining point, and it is connected to the second high-pressure feed water heater 16B. The feed water pipe 15 is a single pipe in the downstream side of the joining point, reaching the reactor 2 via the second high-pressure feed water heater 16B and the first high-pressure feed water heater 16A. In the upstream side of the joining point, the other two feed water pipes 15 are each provided with the low-pressure feed water heaters shown in FIG. 1, that is, the third low-pressure feed water heater 17A, the fourth low-pressure feed water heater 17B, the fifth low-pressure feed water heater 17C, and the sixth low-pressure feed water heater 17D, and the condensate pump 18 in this order from the downstream toward the upstream. Thus, the feed water pipes 15 each having the third low-pressure feed water heater 17A, the fourth low-pressure feed water heater 17B, the fifth low-pressure feed water heater 17C, the sixth low-pressure feed water heater 17D, and the condensate pump 18, corresponding to the low-pressure turbines 5A and 5C are provided upstream of the second high-pressure feed water heater 16B. The low-pressure turbines 5A and 5C are each provided with the extraction points 52, 53, 54, and 55 in the same manner as the low-pressure turbine 5B. The extraction points 52, 53, 54, and 55 of the low-pressure turbine 5A are connected with the extraction pipes 22, 23, 24, and 25 respectively in the same manner as in the low-pressure turbine 5B. The extraction pipes 22, 23, 24, and 25 connected with the low-pressure turbine 5A are connected to the third low-pressure feed water heater 17A, the fourth low-pressure feed water heater 17B, the fifth low-pressure feed water heater 17C, and the sixth low-pressure feed water heater 17D correspondingly provided to the low-pressure turbine 5A in the same manner as in the low-pressure turbine 5B. The extraction points 52, 53, 54, and 55 of the low-pressure turbine 5C, also, are connected with the extraction pipes 22, 23, 24, and 25 respectively in the same manner as in the low-pressure turbine 5B. The extraction pipes 22, 23, 24, and 25 connected with the low-pressure turbine 5C are connected to the third low-pressure feed water heater 17A, the fourth low-pressure feed water heater 17B, the fifth low-pressure feed water heater 17C, and the sixth low-pressure feed water heater 17D correspondingly provided to the low-pressure turbine 5C in the same manner as in the low-pressure turbine 5B.

In the following description, the third low-pressure feed water heater 17A, the fourth low-pressure feed water heater 17B, the fifth low-pressure feed water heater 17C, the sixth low-pressure feed water heater 17D, the extraction pipes 22, 23, 24, and 25, and the extraction points 52, 53, 54, and 55 are those provided to the low-pressure turbine 5B if not otherwise specified.

The steam compression apparatus (steam heat pump) 27 has a steam compressor 28, a driving apparatus (for example, a motor) 29, and a control valve 30. The driving apparatus 29 is linked to the rotating shaft of the steam compressor 28. A steam supply pipe 31 for introducing the steam discharged from the low-pressure turbine 5B is connected to the steam inlet of the steam compressor 28. A steam supply pipe 32 connects the steam outlet of the steam compressor 28 and the sixth low-pressure feed water heater 17D. The steam supply pipes 31 and 32 are second pipes, and in the present embodiment, the extraction pipes 20 to 25 are first pipes. The control valve 30 is provided to the steam supply pipe 32. None of the extraction pipes 20 to 25 for passing extraction steam is provided with the steam compression apparatus 27. As the steam compressor 28, a single-stage centrifugal steam compressor is used. Other types of compressors may be used as the steam compressor 28. The steam compressor 28 and the driving apparatus 29 are installed in an open space in a turbine building.

Cooling water is supplied to a core 7 in the reactor 2 by a recirculation pump (not shown) and a jet pump (not shown). The cooling water is heated by heat generated by the nuclear fission of nuclear fuel material included in a plurality of fuel assemblies (not shown) loaded in the core 7, and part of the cooling water becomes steam. The steam generated in the reactor 2 passes through the main steam pipe 6 and is supplied to the high-pressure turbine 3 and the low-pressure turbines 5A, 5B, and 5C. The steam discharged from the high-pressure turbine 3 is introduced to the low-pressure turbines 5A, 5B, and 5C after moisture was removed by the moisture separator 4 on the way. The pressures in the low-pressure turbines 5A, 5B, and 5C are lower than the pressure in the high-pressure turbine. The high-pressure turbine 3 and the low-pressure turbines 5A, 5B, and 5C are driven by the steam, and rotate the generator 9. This generates electric power. The steam discharged from each of the low-pressure turbines 5A, 5B, and 5C is condensed in the condenser 11, which is separately and correspondingly provided to each low-pressure turbine, and becomes water. Seawater is supplied into each heat exchanger tubes 12 in the condenser 11 through the supplying portion of the seawater pipe 13 by the operation of the seawater circulation pump. The seawater discharged from each heat exchanger tubes 12 is released to the ocean through the return portion of the seawater pipe 13. The steam discharged from each of the low-pressure turbines 5A, 5B, and 5C is cooled by the seawater flowing in each heat exchanger tube 12 and condensed. The condensation of the steam increases the temperature of the seawater flowing in each exchanger tube 12.

The condensate pumps 18 and the feed water pump 19 are each driven. The condensate water generated in each condenser 11 is pressurized by these pumps and supplied to the reactor 2 as feed water through the feed water pipes 15. The feed water flowing in the feed water pipe 15 is sequentially heated by the sixth low-pressure feed water heater 17D, the fifth low-pressure feed water heater 17C, the fourth low-pressure feed water heater 17B, and the third low-pressure feed water heater 17A, which are correspondingly provided to each low-pressure turbine, and further heated in sequence by the second high-pressure feed water heater 16B and the first high-pressure feed water heater 16A, which are commonly provided for the low-pressure turbines 5A, 5B, and 5C, to increase its temperature, and supplied to the reactor 2 at a set temperature (for example, 215° C.).

The feed water is heated in the sixth low-pressure feed water heater 17D by the extraction steam extracted from the extraction point 55 of the low-pressure turbine 5B and supplied through the extraction pipe 25. The feed water is further heated in the fifth low-pressure feed water heater 17C by the extraction steam extracted from the extraction point 54 of the low-pressure turbine 5B and supplied through the extraction pipe 24. The feed water is further heated in the fourth low-pressure feed water heater 17B by the extraction steam extracted from the extraction point 53 of the low-pressure turbine 5B and supplied through the extraction pipe 23. The feed water is further heated in the third low-pressure feed water heater 17A by the extraction steam extracted from the extraction point 52 of the low-pressure turbine 5B and supplied through the extraction pipe 22, and by saturated drain water discharged from the moisture separator 4 and supplied through the drainpipe 26. The feed water is further heated in the second high-pressure feed water heater 16B by the extraction steam extracted from the extraction point 51 of the high-pressure turbine 3 and supplied through the extraction pipe 21. The feed water is further heated in the first high-pressure feed water heater 16A by the extraction steam extracted from the extraction point 50 of the high-pressure turbine 3 and supplied through the extraction pipe 20. The sixth low-pressure feed water heater 17D, the fifth low-pressure feed water heater 17C, the fourth low-pressure feed water heater 17B, and the third low-pressure feed water heater 17A, correspondingly provided to each of the low-pressure turbines 5A and 5C, also, heats the feed water flowing in the respective feed water pipe 15 by using the above extraction steam.

TABLE 1

| | | | Feed water heater to which compressed steam is supplied | | | | | |
|---|---|---|---|---|---|---|---|---|
| | | State quantity of steam to be compressed. | First high-pressure feed water heater | Second high-pressure feed water heater | Third low-pressure feed water heater | Fourth low-pressure feed water heater | Fifth low-pressure feed water heater | Sixth low-pressure feed water heater |
| Temperature | ° C. | 35 | — | — | 150 | 130 | 105 | 75 |
| Pressure | MPa | 0.0056 | — | — | 0.47 | 0.27 | 0.12 | 0.04 |
| Enthalpy | kJ/kg | 2560 | — | — | 2750 | 2720 | 2690 | 2640 |
| Required pressure ratio | | | — | — | 84 | 48 | 21 | 7.1 |
| COP | | | — | — | 2.5 | 2.8 | 3.7 | 5.9 |
| Evaluation | | | — | — | x | x | ○ | ○ |

The function of the steam compression apparatus 27 will be described. The driving apparatus 29 is driven by auxiliary power, that is, the power generated by the generator 9, and a rotor provided with rotor blades of the steam compressor 28 is rotated. The steam discharged from the low-pressure turbine 5B (temperature: 35° C., pressure: 0.0056 MPa) is supplied to the steam compressor 28 through the steam supply pipe 31. This steam is discharged to the steam supply pipe 32 after being compressed by the operation of the steam compressor 28 and increased its pressure. Since the steam is compressed adiabatically by the steam compressor 28, its temperature is also increased. The temperature of the compressed steam is increased to a temperature close to the temperature of the steam extracted from the extraction point 55 of the low-pressure turbine 5B through the extraction pipe 25 (see Table 1). The pressure of the steam discharged from the steam compressor 28 is 0.04 MPa (see Table 1). The steam the temperature and pressure of which were increased is adjusted in pressure by adjusting degree of opening of the control valve 30 to be equal to the pressure inside a shell of the sixth low-pressure feed water heater 17D, then, supplied to the shell side of the sixth low-pressure feed water heater 17D through the steam supply pipe 32. The extraction steam supplied through the extraction pipe 25, also, is supplied to the shell side of the sixth low-pressure feed water heater 17D. In the sixth low-pressure feed water heater 17D, the feed water is heated by the extraction steam supplied through the extraction pipe 25 and the compressed steam supplied through the steam supply pipe 32. The pressure of the compressed steam supplied to the shell side of the sixth low-pressure feed water heater 17D through the steam supply pipe 32 is adjusted by the control valve 30 to prevent exceeding the pressure of the extraction steam supplied into the shell of the sixth low-pressure feed water heater 17D through the extraction pipe 25 in order to avoid back-flow of the compressed steam into the extraction pipe 25.

The steam compression apparatus (steam heat pump) 27 is also provided to each of the low-pressure turbines 5A and 5C. The steam compression apparatus 27 provided to the low-pressure turbine 5A compresses the steam discharged from the low-pressure turbine 5A and supplies it to the sixth low-pressure feed water heater 17D provided to the low-pressure turbine 5A. The steam compression apparatus 27 provided to the low-pressure turbine 5C compresses the steam discharged from the low-pressure turbine 5C and supplies it to the sixth low-pressure feed water heater 17D provided to the low-pressure turbine 5C.

The power uprate operation in the present embodiment will be described. While the reactor 2 is driven at a rated power (100%) in an operation cycle conventionally, in the present embodiment, the reactor is driven by uprating the reactor power up to, for example, 120% in the operation cycle. The operation of the reactor 2 when the reactor power is uprated to 120% is called a power uprate operation. Such power uprating in a boiling water nuclear plant can be achieved, for example, by increasing the capacity of a recirculation pump and by making the rotor blades of the low-pressure turbines 5A, 5B, and 5C longer. Increasing the capacity of the recirculation pump allows the core flow rate to be increased from a conventional rating of 100% to 120%. Thus, in the present embodiment, the reactor power can be further uprated from a rating of 100% to 120% by controlling the core flow rate. In this power uprate operation, the steam compressed in the steam compressor 28 is supplied to the sixth low-pressure feed water heater 17D.

In the present embodiment, the extraction steam (the extraction steam which does not pass the steam compressor 28) extracted from the extraction point 55 of each of the low-pressure turbines 5A, 5B, and 5C and the temperature-increased steam which has been pressurized by the steam compressor 28 of each steam compression apparatus 27 is used as a heat source to heat feed water in each of the sixth low-pressure feed water heaters 17D correspondingly provided to the low-pressure turbines 5A, 5B, and 5C.

The use of thermal energy in a conventional BWR-5 type boiling water nuclear power plant generating an electric power of 1100 MWe without the steam compression apparatus 27 will be described. This conventional boiling water nuclear power plant has a structure of the boiling water nuclear power plant 1 without the steam compression apparatus 27 of the present embodiment. In the conventional boiling water nuclear power plant, the steam flow is optimized in the main steam system including the main steam pipe 6, the high-pressure turbine 3, and the low-pressure turbines 5A, 5B, and 5C to obtain the maximum thermal efficiency at a set thermal power in the core. To be more specific, when steam is condensed into water in the condenser 11, at a pressure of the reactor 2 of approximately 7 MPa, approximately ⅔ of the energy generated in the reactor 2 based on the principle of a thermal cycle is discharged to the external environment through thermal effluent and the like discharged from the condenser 11 to the ocean 35 (not shown). In order to efficiently use this discharged energy, part of the steam generated in the reactor 2 is extracted from the high-pressure turbine 3 and the low-pressure turbines 5A, 5B, and 5C and used for heating the feed water in each feed water heater. Since the heat from the steam generated in the reactor 2 is recovered and the temperature of the feed water supplied to the reactor 2 is increased, the thermal efficiency of the reactor 2 is improved. In the boiling water nuclear power plant 1 having the moisture separator 4, the amount of steam finally discharged to the condenser 11 from the outlet of the low-pressure turbine is approximately 56% of the generated steam. The remaining 44% of steam is used to heat feed water in each feed water heater. The conventional boiling water nuclear power plant, also, has six feed water heaters so that the amount of the extraction steam per feed water heater on average is about 7% of the steam discharged from the reactor 2. On the other hand, in a conventional boiling water nuclear power plant using an advanced boiling water reactor (hereinafter, referred to as an ABWR) provided with a moisture separator reheater or a moisture separator heater in place of the moisture separator 4, the amount of steam finally discharged to the condenser from the outlet of the low-pressure turbine is approximately 54% of the steam generated in the reactor. In order to improve the thermal efficiency of these conventional boiling water nuclear power plants, it has been generally known to change the moisture separator to the moisture separator heater to improve the performance by the reheat effect of the steam. However, the conventional BWR-5 type boiling water nuclear power plant particularly has a moisture separator in a small vessel so that it is extremely difficult to add multiple heat exchanger tubes as heaters within the vessel.

A change in the temperature of feed water flowing in the feed water pipes in the boiling water nuclear power plant 1 using the steam compression apparatus 27 according to the present embodiment and in the conventional boiling water nuclear power plant without using the steam compression apparatus 27 will be described with reference to FIGS. 2 and 3.

Figure 2:
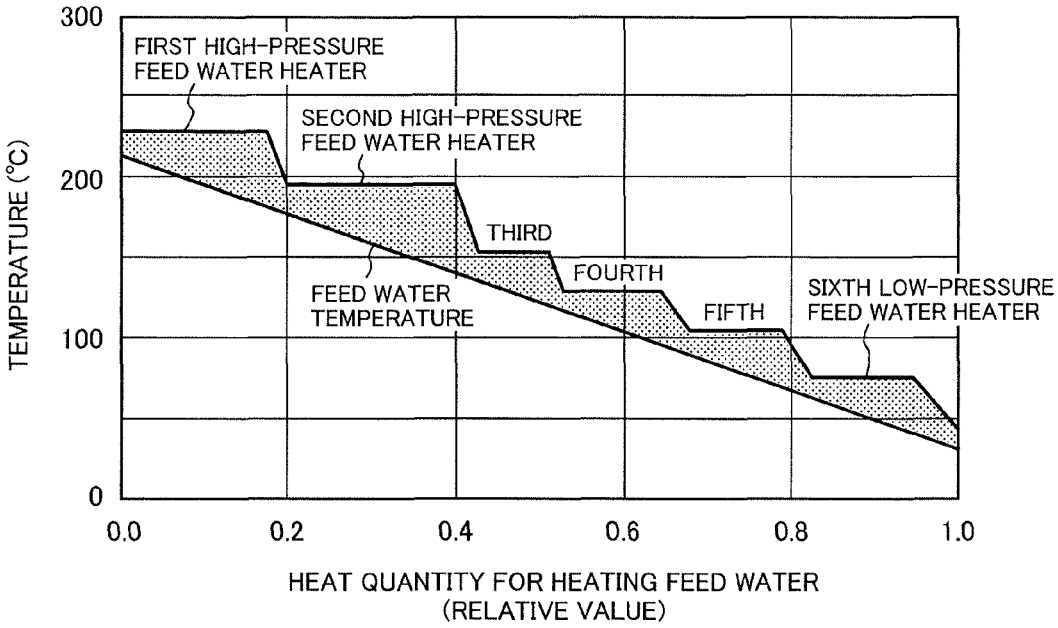
FIG. 2 is an explanatory drawing showing a change in a temperature of feed water in a conventional boiling water nuclear power plant.
Figure 3:
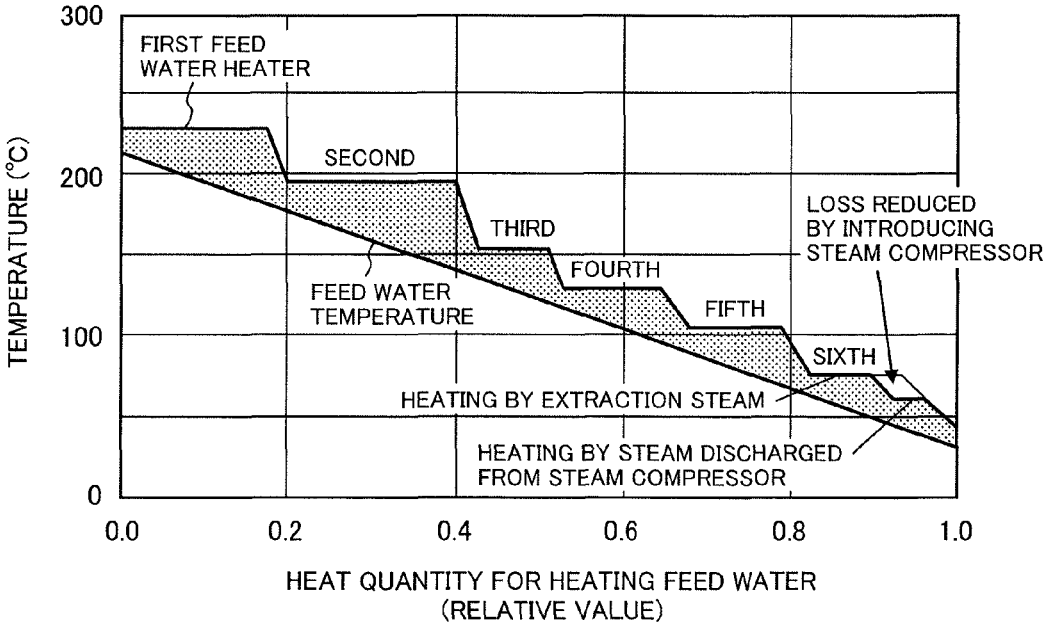
FIG. 3 is an explanatory drawing showing a change in a temperature of feed water in a boiling water nuclear power plant shown in FIG. 1.

In the conventional boiling water nuclear power plant without the steam compression apparatus 27, as shown in FIG. 2, the feed water flowing in the feed water pipe is sequentially heated by six feed water heaters to which the extraction steam having a higher temperature than the feed water is supplied. The temperature of the extraction steam is a saturated steam temperature corresponding to the pressure in a stage of the steam turbine. Since the extraction steam condensates in the shell of the feed water heater, there is a region where the temperature of the extraction steam, which is a heat source, is constant at a saturation temperature corresponding to the steam pressure. The area surrounded by the heating fluid and the heated fluid shows heat loss during heat exchange, thus, in order to exchange heat efficiently, the loss during heat exchange should be minimized.

As in the present embodiment, when the steam the temperature of which was raised by being compressed in the steam compression apparatus 27 is used for heating, the steam discharged from the steam compression apparatus 27 can be made to any temperature by adjusting the operating condition of the steam compressor. Heating by the extraction steam and heating by the steam discharged from the steam compressor are performed separately by setting up a divider in the shell of the sixth low-pressure feed water heater 17D. When the pressure of the steam discharged from the steam compressor is adjusted to be lower than the pressure of the extraction steam, in the region of heating by the steam discharged from the steam compressor as shown in FIG. 3, a temperature difference between the temperatures of the heating fluid and of the heated fluid can be made smaller than the conventional example in FIG. 2. The feed water in the example in FIG. 3 can be heated to the same temperature as in the example in FIG. 2. This means that the feed water is heated to the required temperature and at the same time, a loss during the heat exchange is decreased as shown in the white area indicated by the arrow in FIG. 3. When the pressure of the steam discharged from the steam compressor is adjusted to be higher than the pressure of the extraction steam, it is equivalent to the feed water heating required in the fifth low-pressure feed water heater 17C performed earlier at a temperature lower than the extraction steam for the fifth low-pressure feed water heater, thus the flow rate of the extraction steam to the fifth low-pressure feed water heater can be reduced, that is, a loss during heat exchange can be reduced. According to the above, the thermal efficiency of the boiling water nuclear power plant 1 according to the present embodiment is improved.

When the power uprating operation for uprating a rated reactor power further is performed in the boiling water nuclear power plant 1, the flow rate of the steam discharged from the reactor 2 increases. For this reason, it is preferred that the steam of low-temperature and low-pressure used for rotating the generator 9 in the low-pressure turbines 5A, 5B, and 5C during the power uprating operation is not discharged to the condenser 11 but used for heating the feed water by as much as possible for the purpose of heat recovery.

The present embodiment, as described above, is provided with the steam compression apparatus 27, and steam compressed and temperature-raised by the steam compressor 28 is supplied to the sixth low-pressure feed water heater 17D to heat the feed water. Because of this, the temperature of the feed water supplied to the reactor 2 is increased more than the temperature of the feed water in the conventional boiling water nuclear power plant. Due to the increase in the feed water temperature, the heat generated by nuclear fission in the reactor 2 can be efficiently used for steam generation, allowing the flow rate of the steam discharged from the reactor 2 to be increased. Thus, the thermal efficiency of the boiling water nuclear power plant 1 can be further improved.

In the present embodiment, the steam compression apparatus 27 is provided so as to compress the steam discharged from the low-pressure turbine and to supply the compressed steam to the sixth low-pressure feed water heater 17D, thus the coefficient of performance COP of the steam compression apparatus (steam heat pump) 27 is 5.9, as shown in Table 1, satisfying COP>3. Therefore, in the present embodiment, as described above, the low-energy steam in the boiling water nuclear power plant, that is, the steam discharged from the low-pressure turbine, having a lower energy than the steam extracted from the low-pressure turbine 5B through the extraction pipe 25, is converted by the steam compression apparatus 27 into the compressed steam having a higher energy to be used for heating the feed water. Thus, the thermal efficiency of the boiling water nuclear power plant 1 can be further improved.

In particular, the present embodiment uses the extraction steam from the low-pressure turbine 5B and the steam compressed by the steam compressor 28 to heat the feed water in the sixth low-pressure feed water heater 17D so that a rate of increase in the temperature of the steam compressed by the steam compressor 28 is less than that of the steam in the compressor disclosed in Japanese Utility Model Laid-Open No. 1 (1989)-123001. Thus, the auxiliary power consumed by the steam compressor 28 for compressing the steam is less than the power consumed by the compressor disclosed in Japanese Utility Model Laid-Open No. 1 (1989)-123001. This decrease in the consumption of auxiliary power also contributes to an increase in the thermal efficiency of the boiling water nuclear power plant 1. The steam compressor 28 used in the present embodiment is smaller than the compressor stated in Japanese Utility Model Laid-Open No. 1 (1989)-123001 so that less auxiliary power is consumed. Accordingly, the thermal efficiency of the boiling water nuclear power plant 1 can be further improved.

The improvements in the thermal efficiency of the boiling water nuclear power plant 1 described above can further be improved the thermal efficiency of the boiling water nuclear power plant 1 when the power uprating operation is performed in the boiling water nuclear power plant 1.

In the present embodiment, since the feed water is heated by the steam compressed by the steam compressor 28, the temperature of the thermal effluent discharged to the ocean from the condenser 11 through the seawater discharge pipe 13 can be reduced.

The present embodiment is applicable to an ABWR-type boiling water nuclear plant generating an electric power of 1350 MWe. Embodiments 2 to 7 and 9 to be described later are also applicable to the ABWR-type boiling water nuclear power plant.

In the boiling water nuclear power plant 1, when the compressed steam obtained by compressing the steam discharged from the low-pressure turbine by the compressor 28 is supplied to the fifth low-pressure feed water heater 17C, the coefficient of performance COP of the steam compression apparatus (steam heat pump) 27 becomes 3.7 as shown in Table 1. This, also, satisfies COP>3 and improves the thermal efficiency of the boiling water nuclear power plant 1. Therefore, in the boiling water nuclear power plant 1, the steam supply pipe 32 connected to the steam compressor 28 may be connected to the fifth low-pressure feed water heater 17C connected to the extraction pipe 24 in place of the sixth low-pressure feed water heater 17D. However, by connecting the steam supply pipe 32 to the fourth low-pressure feed water heater 17B, the coefficient of performance COP of the steam compression apparatus 27 becomes 2.8 as shown in Table 1. Because of this, when the steam discharged from the low-pressure turbine is compressed by the steam compressor 28 and supplied to the fourth low-pressure feed water heater 17B, the thermal efficiency of the boiling water nuclear power plant 1 decreases compared to the one without the steam compression apparatus 27 because the auxiliary power consumed by the operation of the steam compressor 28 is increased. When the steam discharged from the low-pressure turbine is compressed by the steam compression apparatus 27 and supplied to the feed water heater, the steam compressed by the steam compression apparatus 27 should be supplied to the sixth low-pressure feed water heater 17D or the fifth low-pressure feed water heater 17C.

Embodiment 2

Figure 5:
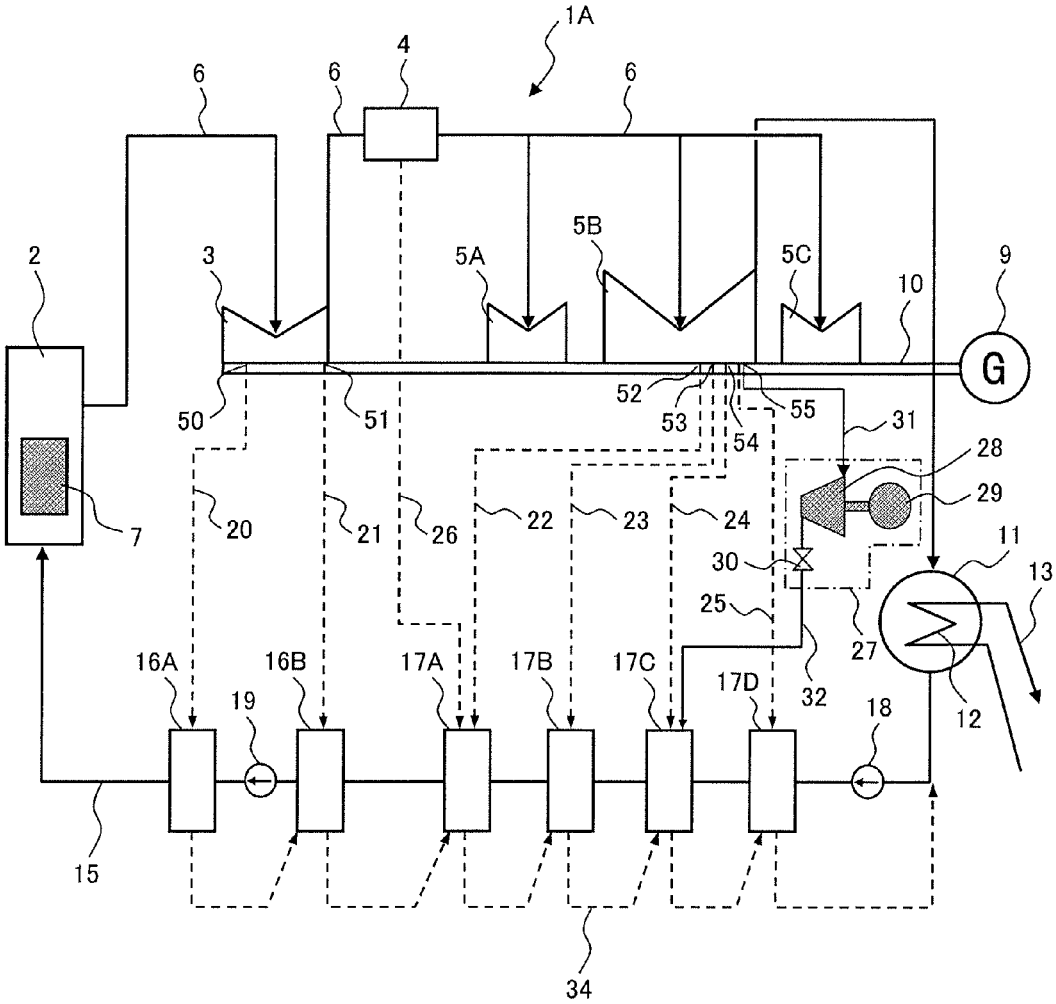
FIG. 5 is a structural diagram showing a power plant according to embodiment 2, which is another embodiment of the present invention, applied to a boiling water nuclear power plant.

A power plant according to embodiment 2, which is another embodiment of the present invention, will be described with reference to FIG. 5. The power plant according to the present embodiment is a BWR-5 type boiling water nuclear power plant 1A generating an electric power of 1100 MWe.

The boiling water nuclear power plant 1A according to the present embodiment has a structure of the boiling water nuclear power plant 1 in embodiment 1 except that the steam compression apparatus (steam heat pump) 27 is connected to the extraction point 55 of the low-pressure turbine 5B and the third low-pressure feed water heater 17C. The other structures of the boiling water nuclear power plant 1A are the same as the boiling water nuclear power plant 1. The steam supply pipe 31 connects the steam inlet of the steam compressor 28 and the extraction point 55 of the low-pressure turbine 5B. The steam supply pipe 32 connects the steam outlet of the steam compressor 28 and the fifth low-pressure feed water heater 17C. The extraction point 55 connected with the extraction pipe 25 and the extraction point 55 connected with the steam supply pipe 31 are located at positions that are in a same stage of stationary blade of the low-pressure turbine 5B and away from each other in the circumferential direction of the low-pressure turbine 5B. The steam compression apparatuses 27 correspondingly provided to the low-pressure turbines 5A and 5C, also, are connected to the low-pressure turbines 5A and 5C and the corresponding fifth low-pressure feed water heaters 17C in the same manner. The steam supply pipe 31 may be connected to the extraction pipe 25. To prevent the rate of steam supplied to the sixth low-pressure feed water heater 17C through the extraction pipe 25 from being decreased by the operation of the steam compressor 28, the cross-sectional area of the flow passage of the steam supply pipe 31 is made smaller than that of the extraction pipe 25. Instead of varying the cross-sectional area of the flow passage of the pipe, a flow rate adjusting valve may be provided to the steam supply pipe 31 to adjust the rate of steam supplied to the steam compressor 28. The method of adjusting the steam flow rate of the steam supply pipe and the extraction pipe which supply the steam to the same feed water heater is also applicable to each embodiment in embodiments 3 to 9 to be described later.

TABLE 2

| | | | Feed water heater to which compressed steam is supplied | | | | | |
|---|---|---|---|---|---|---|---|---|
| | | State quantity of steam to be compressed. | First high-pressure feed water heater | Second high-pressure feed water heater | Third low-pressure feed water heater | Fourth low-pressure feed water heater | Fifth low-pressure feed water heater | Sixth low-pressure feed water heater |
| Temperature | ° C. | 75 | — | 195 | 150 | 130 | 105 | — |
| Pressure | MPa | 0.04 | — | 1.5 | 0.47 | 0.27 | 0.12 | — |
| Enthalpy | kJ/kg | 2640 | — | 2790 | 2750 | 2720 | 2690 | — |
| Required pressure ratio | | | — | 38 | 12 | 6.8 | 3.0 | — |
| COP | | | — | 2.7 | 4.2 | 5.3 | 9.0 | — |
| Evaluation | | | — | x | ○ | ○ | ○ | — |

During the operation of the boiling water nuclear power plant 1A, the steam extracted from the extraction point 55 of the low-pressure turbine 5B is compressed by the steam compressor 28 and supplied to the fifth low-pressure feed water heater 17C. The extraction steam extracted from the extraction point 54 of the low-pressure turbine 5B is supplied to the fifth low-pressure feed water heater 17C through the extraction pipe 24. The steam extracted from the extraction point 55 of the low-pressure turbine 5B and supplied to the steam compressor 28 is a temperature of 75° C. and a pressure of 0.04 MPa, as shown in Table 2. The steam compressed by the steam compressor 28 and supplied to the fifth low-pressure feed water heater 17C is a temperature of 105° C. and a pressure of 0.12 MPa (see Table 2).

In the present embodiment, the steam compression apparatus 27 is provided so as to compress the steam extracted from the extraction point 55 of the low-pressure turbine 5B and to supply the compressed steam to the fifth low-pressure feed water heater 17C, thus the coefficient of performance COP of the steam compression apparatus 27 becomes 9.0, as shown in Table 2, satisfying COP>3. Therefore, in the present embodiment, the steam discharged from the extraction point 55 of the low-pressure turbine 5B, having a lower energy than the steam extracted from the extraction point 54 of the low-pressure turbine 5B through the extraction pipe 24 and supplied to the fifth low-pressure feed water heater 17C, can be converted by the steam compression apparatus 27 into the compressed steam having a higher energy to be used for heating the feed water, thus the thermal efficiency of the boiling water nuclear power plant 1A can be further improved.

The present embodiment can obtain each effect generated in the embodiment 1. In the present embodiment, the pressure of the steam supplied to the steam compressor 28 is higher than that in the embodiment 1 (see Tables 1 and 2). Therefore, in the present embodiment, since the specific volume of the steam supplied to the steam compressor 28 is smaller than that in the embodiment 1, the steam at the same flow rate as in the embodiment 1 can be compressed using a relatively small steam compressor compared to the embodiment 1. In addition, when the steam compressor 28 in the present embodiment is the same size as the steam compressor 28 in the embodiment 1, more steam can be compressed in the present embodiment than in the embodiment 1. The present embodiment can improve the thermal efficiency of the boiling water nuclear power plant more than the embodiment 1.

In the boiling water nuclear power plant 1A, when the compressed steam obtained by compressing the steam discharged from the extraction point 55 located in the most downstream side of the low-pressure turbine 5B by the compressor 28 is supplied not to the fifth low-pressure feed water heater 17C but to either one of the fourth low-pressure feed water heater 17B or the third low-pressure feed water heater 17A, also, the thermal efficiency of the boiling water nuclear power plant 1A can be improved. The coefficient of performance COP of the steam compression apparatus 27 becomes 5.3, as shown in Table 2, when the compressed steam is supplied to the fourth low-pressure feed water heater 17B, and 4.2 when it is supplied to the third low-pressure feed water heater 17A. COP>3 is satisfied in these cases so that the thermal efficiency of the boiling water nuclear power plant 1A can be improved. Therefore, in the boiling water nuclear power plant 1A, the steam supply pipe 32 connected to the steam compressor 28 may be connected to the fourth low-pressure feed water heater 17B connected to the extraction pipe 23 or to the third low-pressure feed water heater 17A connected to the extraction pipe 22 and the drain water pipe 26 in place of the fifth low-pressure feed water heater 17C. Connecting the steam supply pipe 32 to the second high-pressure feed water heater 16B, however, makes the coefficient of performance COP of the steam compression apparatus 27 to be 2.7, as shown in Table 2, not satisfying COP>3. Because of this, when the steam extracted from the low-pressure turbine 5C is compressed by the steam compressor 28 and supplied to the second high-pressure feed water heater 16B, the thermal efficiency of the boiling water nuclear power plant 1A reduces compared to the one without the steam compression apparatus 27 because the auxiliary power consumed by the steam compressor 28 is increased. When the steam extracted from the extraction point 55 of the low-pressure turbine 5B is compressed by the steam compression apparatus 27 and supplied to the feed water heater, the steam compressed by the steam compression apparatus 27 is preferably supplied to one of the fifth low-pressure feed water heater 17C, the fourth low-pressure feed water heater 17B, or the third low-pressure feed water heater 17A.

Embodiment 3

Figure 6:
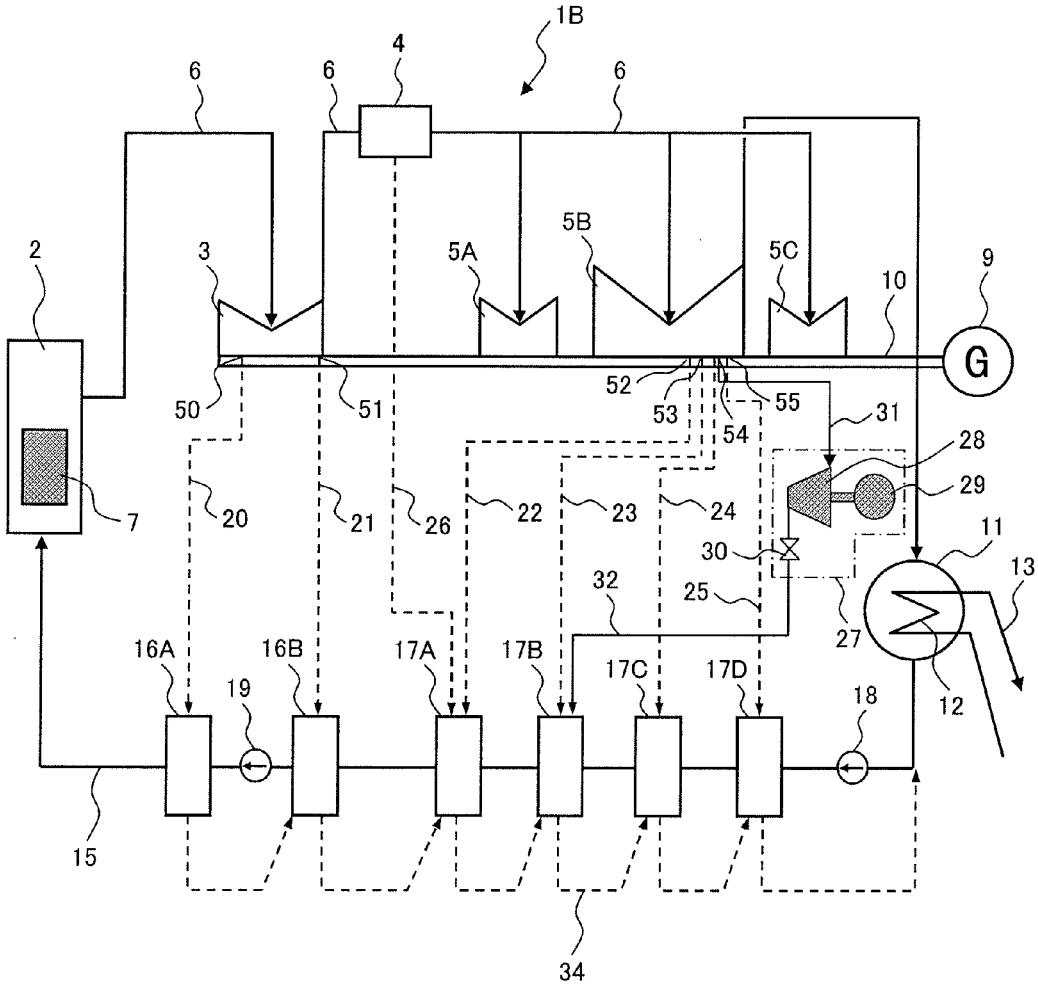
FIG. 6 is a structural diagram showing a power plant according to embodiment 3, which is another embodiment of the present invention, applied to a boiling water nuclear power plant.

A power plant according to Embodiment 3, which is another embodiment of the present invention, will be described with reference to FIG. 6. The power plant according to the present embodiment is a BWR-5 type boiling water nuclear power plant 1B generating an electric power of 1100 MWe.

The boiling water nuclear power plant 1B in the present embodiment has the structure of the boiling water nuclear power plant 1 in the embodiment 1 except that the steam compression apparatus (steam heat pump) 27 is connected to the extraction point 54 of the low-pressure turbine 5B and the fourth low-pressure feed water heater 17B. The other structures of the boiling water nuclear power plant 1B are the same as the boiling water nuclear power plant 1. The steam supply pipe 31 connects the steam inlet of the steam compressor 28 and the extraction point 54 of the low-pressure turbine 5B. The steam supply pipe 32 connects the steam outlet of the steam compressor 28 and the fourth low-pressure feed water heater 17B. The extraction point 54 connected with the extraction pipe 24 and the extraction point 54 connected with the steam supply pipe 31 are located at positions that are in a same stage of stationary blade of the low-pressure turbine 5B and away from each other in the circumferential direction of the low-pressure turbine 5B. The steam compression apparatuses 27 correspondingly provided to the low-pressure turbines 5A and 5C, also, are connected to the fourth low-pressure feed water heaters 17B corresponding to the low-pressure turbines 5A and 5C in the same manner. The steam supply pipe 31 may be connected to the extraction pipe 24.

TABLE 3

| | | | Feed water heater to which compressed steam is supplied | | | | | |
|---|---|---|---|---|---|---|---|---|
| | | State quantity of steam to be compressed. | First high-pressure feed water heater | Second high-pressure feed water heater | Third low-pressure feed water heater | Fourth low-pressure feed water heater | Fifth low-pressure feed water heater | Sixth low-pressure feed water heater |
| Temperature | ° C. | 105 | 220 | 195 | 150 | 130 | — | — |
| Pressure | MPa | 0.12 | 2.4 | 1.5 | 0.47 | 0.27 | — | — |
| Enthalpy | kJ/kg | 2690 | 2800 | 2790 | 2750 | 2720 | — | — |
| Required pressure ratio | | | 20 | 13 | 3.9 | 2.3 | — | — |
| COP | | | 2.97 | 3.9 | 7.0 | 11.3 | — | — |
| Evaluation | | | x | ○ | ○ | ○ | — | — |

During the operation of the boiling water nuclear power plant 1B, the steam extracted from the extraction point 54 of the low-pressure turbine 5B is compressed by the steam compressor 28 and supplied to the fourth low-pressure feed water heater 17B. The extraction steam extracted from the extraction point 53 of the low-pressure turbine 5B is supplied to the fourth low-pressure feed water heater 17B through the extraction pipe 23. The steam extracted from the extraction point 54 of the low-pressure turbine 5B and supplied to the steam compressor 28 has a temperature of 105° C. and a pressure of 0.12 MPa, as shown in Table 3. The steam compressed by the steam compressor 28 and supplied to the fourth low-pressure feed water heater 17B is a temperature of 130° C. and a pressure of 0.27 MPa (see Table 3).

In the present embodiment, the steam compression apparatus 27 is provided so as to compress the steam extracted from the extraction point 54 of the low-pressure turbine 5B and to supply the compressed steam to the fourth low-pressure feed water heater 17B, thus the coefficient of performance COP of the steam compression apparatus 27 becomes 11.3, as shown in Table 3, satisfying COP>3. Therefore, in the present embodiment, the steam discharged from the extraction point 54 of the low-pressure turbine 5B, having a lower energy than the steam extracted from the extraction point 53 of the low-pressure turbine 5B through the extraction pipe 23 and supplied to the fourth low-pressure feed water heater 17B, can be converted by the steam compression apparatus 27 into the compressed steam having a higher energy to be used for heating the feed water, thus the thermal efficiency of the boiling water nuclear power plant 1B can be further improved.

The present embodiment can obtain each effect generated in the embodiment 1. The present embodiment can improve the thermal efficiency of the boiling water nuclear power plant more than the embodiment 2.

In the boiling water nuclear power plant 1B, when the compressed steam obtained by compressing the steam discharged from the extraction point 54, which is the second farthest point from the steam inlet of the low-pressure turbine 5B, by the compressor 28, is supplied not to the fourth low-pressure feed water heater 17B but to either one of the third low-pressure feed water heater 17A or the second high-pressure feed water heater 16B, also, the thermal efficiency of the boiling water nuclear power plant 1B can be improved. The coefficient of performance COP of the steam compression apparatus 27 becomes 7.0, as shown in Table 3, when the compressed steam is supplied to the third low-pressure feed water heater 17A, and 3.9 when it is supplied to the second high-pressure feed water heater 16B. COP>3 is satisfied in these cases also, allowing the thermal efficiency of the boiling water nuclear power plant 1B to be improved. Therefore, in the boiling water nuclear power plant 1B, the steam supply pipe 32 connected to the steam compressor 28 may be connected to the third low-pressure feed water heater 17A connected to the extraction pipe 22 and the drain water pipe 26 or to the second high-pressure feed water heater 16B connected to the extraction pipe 21 in place of the fourth low-pressure feed water heater 17B.

TABLE 4

| | | State quantity of steam to be compressed. | Feed water heater to which compressed steam is supplied | | | | | |
|---|---|---|---|---|---|---|---|---|
| | | | First high-pressure feed water heater | Second high-pressure feed water heater | Third low-pressure feed water heater | Fourth low-pressure feed water heater | Fifth low-pressure feed water heater | Sixth low-pressure feed water heater |
| Temperature | ° C. | 130 | 220 | 195 | 150 | — | — | — |
| Pressure | MPa | 0.27 | 2.4 | 1.5 | 0.47 | — | — | — |
| Enthalpy | kJ/kg | 2720 | 2800 | 2790 | 2750 | — | — | — |
| Required pressure ratio | | | 8.9 | 5.6 | 1.7 | — | — | — |
| COP | | | 3.7 | 4.9 | 16.1 | — | — | — |
| Evaluation | | | ○ | ○ | ○ | — | — | — |

Connecting the steam supply pipe 32 to the first high-pressure feed water heater 16A makes the coefficient of performance COP of the steam compression apparatus 27 to be 2.97, as shown in Table 3, not satisfying COP>3. Because of this, when the steam extracted from the low-pressure turbine 5B is compressed by the steam compressor 28 and supplied to the first high-pressure feed water heater 16A, the thermal efficiency of the boiling water nuclear power plant 1A reduces compared to the plant without the steam compression apparatus 27 because the auxiliary power consumed by the steam compressor 28 is increased. When the steam extracted from the extraction point 54 of the low-pressure turbine 5B is compressed by the steam compression apparatus 27 and supplied to the feed water heater, the steam compressed by the steam compression apparatus 27 is preferably supplied to one of the fourth low-pressure feed water heater 17B, the third low-pressure feed water heater 17A, or the second high-pressure feed water heater 16B.

Embodiment 4

Figure 7:
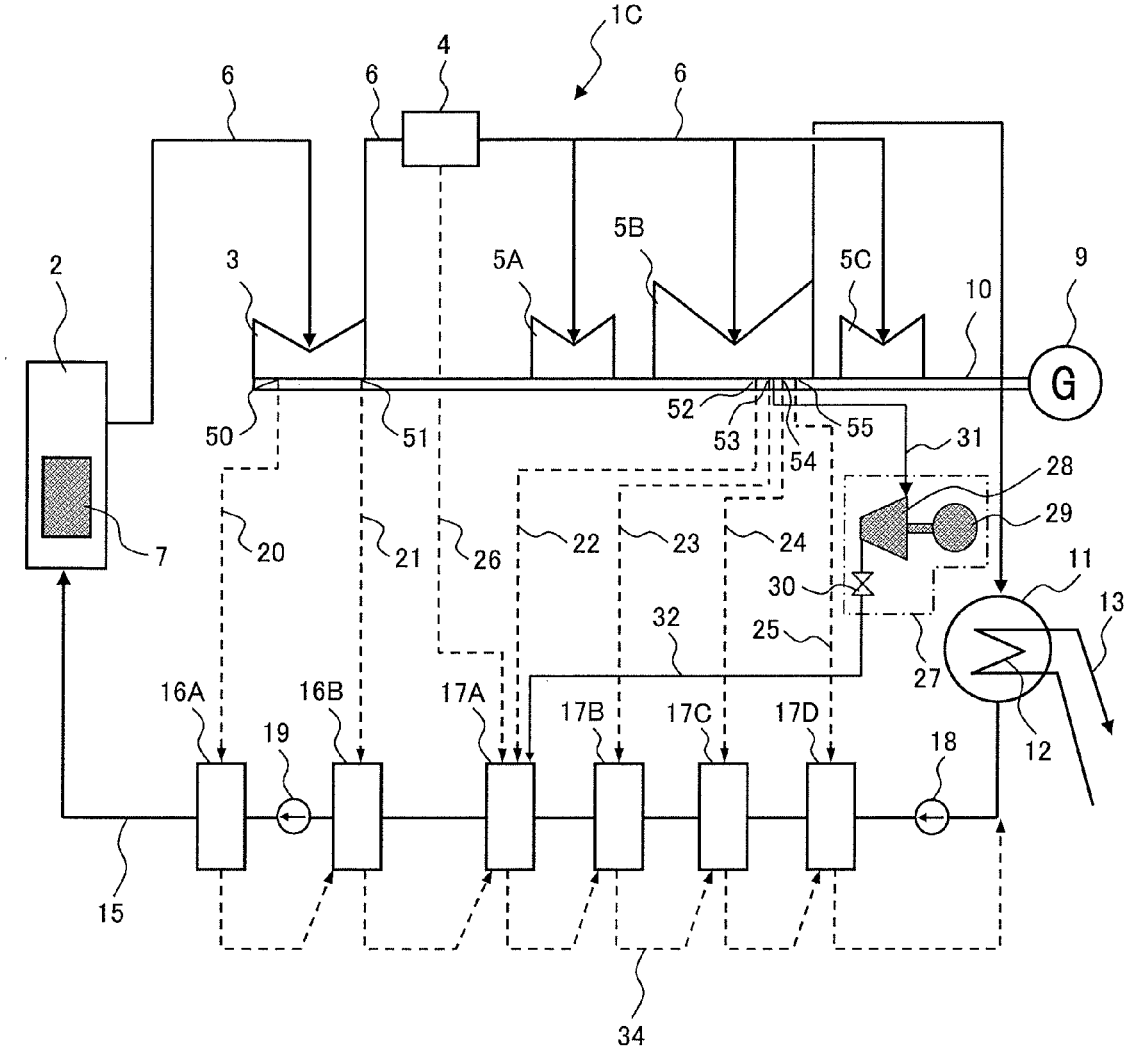
FIG. 7 is a structural diagram showing a power plant according to embodiment 4, which is another embodiment of the present invention, applied to a boiling water nuclear power plant.

A power plant according to embodiment 4, which is another embodiment of the present invention, will be described with reference to FIG. 7. The power plant according to the present embodiment is a BWR-5 type boiling water nuclear power plant 1C generating an electric power of 1100 MWe.

The boiling water nuclear power plant 1C according to the present embodiment has the structure of the boiling water nuclear power plant 1 in the embodiment 1 except that the steam compression apparatus (steam heat pump) 27 is connected to the extraction point 53 of the low-pressure turbine 5B and the third low-pressure feed water heater 17A. The other structures of the boiling water nuclear power plant 1C are the same as the boiling water nuclear power plant 1. The steam supply pipe 31 connects the steam inlet of the steam compressor 28 and the extraction point 53 of the low-pressure turbine 5B, which is the third farthest point from the steam inlet. The steam supply pipe 32 connects the steam outlet of the steam compressor 28 and the third low-pressure feed water heater 17A. The extraction point 53 connected with the extraction pipe 23 and the extraction point 53 connected with the steam supply pipe 31 are located at positions that are in a same stage of stationary blade of the low-pressure turbine 5B and away from each other in the circumferential direction of the low-pressure turbine 5B. The steam compression apparatuses 27 correspondingly provided to the low-pressure turbines 5A and 5C, also, are connected to the third low-pressure feed water heaters 17A corresponding to the low-pressure turbines 5A and 5C in the same manner. The steam supply pipe 31 may be connected to the extraction pipe 23.

During the operation of the boiling water nuclear power plant 1C, the steam extracted from the extraction point 53 of the low-pressure turbine 5B is compressed by the steam compressor 28 and supplied to the third low-pressure feed water heater 17A. The extraction steam extracted from the extraction point 52 of the low-pressure turbine 5B is supplied to the third low-pressure feed water heater 17A through the extraction pipe 22. The steam extracted from the extraction point 53 of the low-pressure turbine 5B and supplied to the steam compressor 28 is a temperature of 130° C. and a pressure of 0.27 MPa, as shown in Table 4. The steam compressed by the steam compressor 28 and supplied to the third low-pressure feed water heater 17A is a temperature of 150° C. and a pressure of 0.47 MPa (see Table 4).

In the present embodiment, the steam compression apparatus 27 is provided so as to compress the steam extracted from the extraction point 53 of the low-pressure turbine 5B and to supply the compressed steam to the third low-pressure feed water heater 17A, thus the coefficient of performance COP of the steam compression apparatus 27 becomes 16.1, as shown in Table 4, satisfying COP>3. Therefore, in the present embodiment, the steam discharged from the low-pressure turbine 5A, having a lower energy than the steam extracted from the extraction point 52 of the low-pressure turbine 5B through the extraction pipe 22 and supplied to the third low-pressure feed water heater 17A, can be converted by the steam compression apparatus 27 into the compressed steam having a higher energy to be used for heating the feed water, so that the thermal efficiency of the boiling water nuclear power plant 1C can be further improved.

The present embodiment can obtain each effect generated in the embodiment 1. The present embodiment can improve the thermal efficiency of the boiling water nuclear power plant more than the embodiment 3.

In the boiling water nuclear power plant 1C, when the compressed steam obtained by compressing the steam discharged from the extraction point 53 of the low-pressure turbine 5B, by the compressor 28, is supplied not to the third low-pressure feed water heater 17A but to either one of the second high-pressure feed water heater 16B or the first high-pressure feed water heater 16A, also, the thermal efficiency of the boiling water nuclear power plant 1C can be improved. The coefficient of performance COP of the steam compression apparatus 27 becomes 4.9, as shown in Table 4, when the compressed steam is supplied to the second high-pressure feed water heater 16B, and 3.7 when it is supplied to the first high-pressure feed water heater 16A. COP>3 is satisfied in these cases also, allowing the thermal efficiency of the boiling water nuclear power plant 1C to be improved. Therefore, in the boiling water nuclear power plant 1C, the steam supply pipe 32 connected to the steam compressor 28 may be connected to the second high-pressure feed water heater 16B connected to the extraction pipe 21 or to the first high-pressure feed water heater 16A connected to the extraction pipe 20 in place of the third low-pressure feed water heater 17A.

When the steam extracted from the extraction point 53 of the low-pressure turbine 5B is compressed by the steam compression apparatus 27 and supplied to the feed water heater, the steam compressed by the steam compression apparatus 27 is preferably supplied to one of the third low-pressure feed water heater 17A, the second high-pressure feed water heater 16B, or the first low-pressure feed water heater 16A.

Embodiment 5

Figure 8:
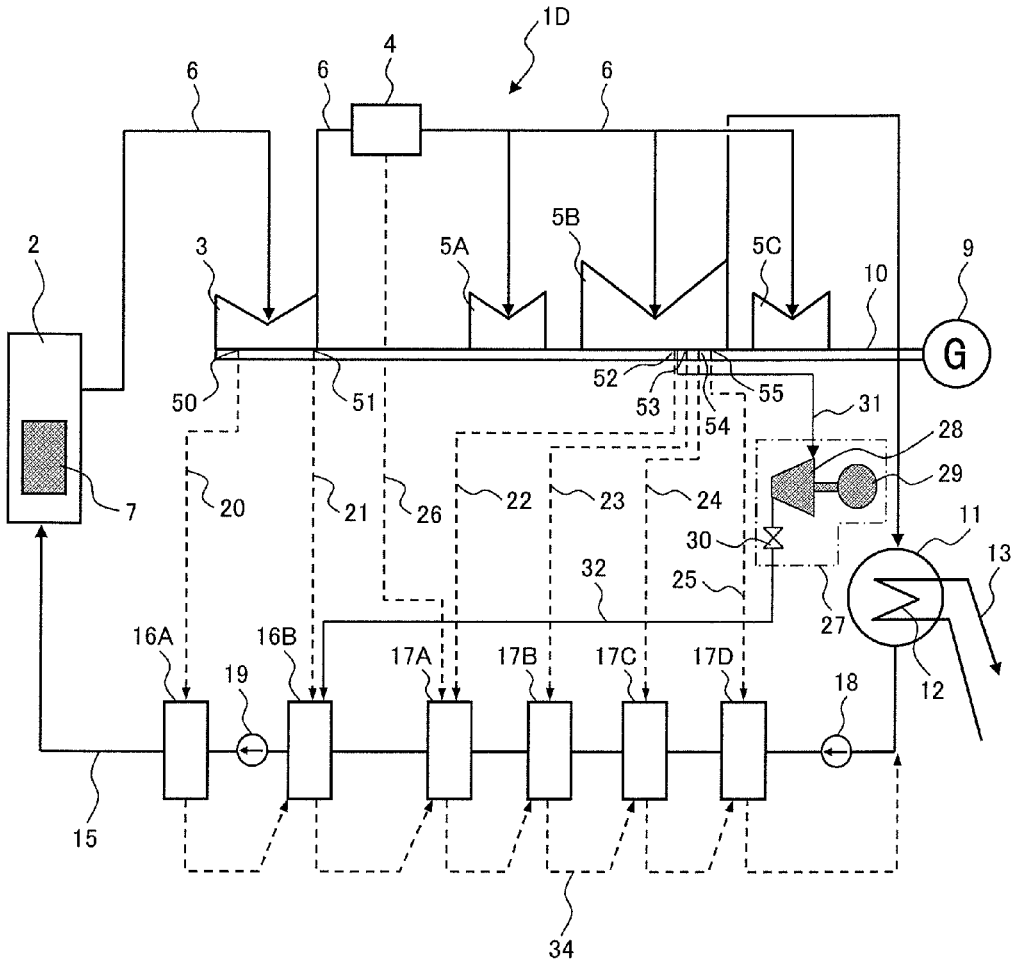
FIG. 8 is a structural diagram showing a power plant according to embodiment 5, which is another embodiment of the present invention, applied to a boiling water nuclear power plant.

A power plant according to embodiment 5, which is another embodiment of the present invention, will be described with reference to FIG. 8. The power plant according to the present embodiment is a BWR-5 type boiling water nuclear power plant 1D generating an electric power of 1100 MWe.

The boiling water nuclear power plant 1D according to the present embodiment has the structure of the boiling water nuclear power plant 1 in the embodiment 1 except that the steam compression apparatus (steam heat pump) 27 is connected to the extraction point 52 of the low-pressure turbine 5B and the second high-pressure feed water heater 16B. The other structures of the boiling water nuclear power plant 1D are the same as the boiling water nuclear power plant 1. The steam supply pipe 31 connects the steam inlet of the steam compressor 28 and the extraction point 52 of the low-pressure turbine 5B. The steam supply pipe 32 connects the steam outlet of the steam compressor 28 and the second high-pressure feed water heater 16B. The extraction point 52 connected with the extraction pipe 22 and the extraction point 52 connected with the steam supply pipe 31 are located at positions that are in a same stage of stationary blade of the low-pressure turbine 5B and away from each other in the circumferential direction of the low-pressure turbine 5B. The steam compression apparatuses 27 correspondingly provided to the low-pressure turbine 5A and 5C, also, are connected to the second high-pressure feed water heaters 16B corresponding to the low-pressure turbines 5A and 5C in the same manner. The steam supply pipe 31 may be connected to the extraction pipe 22.

During the operation of the boiling water nuclear power plant 1D, the steam extracted from the extraction point 52 of the low-pressure turbine 5B is compressed by the steam compressor 28 and supplied to the second high-pressure feed water heater 16B. The extraction steam extracted from the extraction point 51 of the high-pressure turbine 3 is supplied to the second high-pressure feed water heater 16B through the extraction pipe 21. The steam extracted from the extraction point 52 located in the most upstream side of the low-pressure turbine 5B and supplied to the steam compressor 28 is a temperature of 150° C. and a pressure of 0.47 MPa, as shown in Table 5. The steam compressed by the steam compressor 28 and supplied to the second high-pressure feed water heater 16B is a temperature of 195° C. and a pressure of 1.5 MPa (see Table 5).

In the present embodiment, the steam compression apparatus 27 is provided so as to compress the steam extracted from the extraction point 52 of the low-pressure turbine 5B and to supply the compressed steam to the second high-pressure feed water heater 16B, thus the coefficient of performance COP of the steam compression apparatus 27 becomes 6.6, as shown in Table 5, satisfying COP>3. Therefore, in the present embodiment, the steam extracted from the extraction point 52 of the low-pressure turbine 5B, having a lower energy than the steam extracted from the extraction point 51 of the high-pressure turbine 3 through the extraction pipe 21 and supplied to the second high-pressure feed water heater 16B, can be converted by the steam compression apparatus 27 into the compressed steam having a higher energy to be used for heating the feed water, thus the thermal efficiency of the boiling water nuclear power plant 1D can be further improved.

The present embodiment can obtain each effect generated in the embodiment 1. The present embodiment can improve the thermal efficiency of the boiling water nuclear power plant more than the embodiment 4.

In the boiling water nuclear power plant 1D, when the compressed steam obtained by compressing the steam extracted from the extraction point 52 of the low-pressure turbine 5B, by the compressor 28, is supplied not to the second high-pressure feed water heater 16B but to the first high-pressure feed water heater 16A, also, the thermal efficiency of the boiling water nuclear power plant 1D can be improved. The coefficient of performance COP of the steam compression apparatus 27 becomes 4.6, as shown in Table 5, when the compressed steam is supplied to the first high-pressure feed water heater 16A. COP>3 is satisfied in this case also, allowing the thermal efficiency of the boiling water nuclear power plant 1D to be improved. Therefore, in the boiling water nuclear power plant 1D, the steam supply pipe 32 connected to the steam compressor 28 may be connected to

TABLE 5

| | | | Feed water heater to which compressed steam is supplied | | | | | |
|---|---|---|---|---|---|---|---|---|
| | | State quantity of steam to be compressed. | First high-pressure feed water heater | Second high-pressure feed water heater | Third low-pressure feed water heater | Fourth low-pressure feed water heater | Fifth low-pressure feed water heater | Sixth low-pressure feed water heater |
| Temperature | ° C. | 150 | 220 | 195 | — | — | — | — |
| Pressure | MPa | 0.47 | 2.4 | 1.5 | — | — | — | — |
| Enthalpy | kJ/kg | 2745 | 2800 | 2790 | — | — | — | — |
| Required pressure ratio | | | 5.1 | 3.2 | — | — | — | — |
| COP | | | 4.6 | 6.6 | — | — | — | — |
| Evaluation | | | ○ | ○ | — | — | — | — |

the first high-pressure feed water heater 16A connected to the extraction pipe 20 in place of the second high-pressure feed water heater 16B.

When the steam extracted from the extraction point 52 of the low-pressure turbine 5B is compressed by the steam compression apparatus 27 and supplied to the feed water heater, the steam compressed by the steam compression apparatus 27 is preferably supplied to one of the second high-pressure feed water heater 16B or the first low-pressure feed water heater 16A.

Embodiment 6

Figure 9:
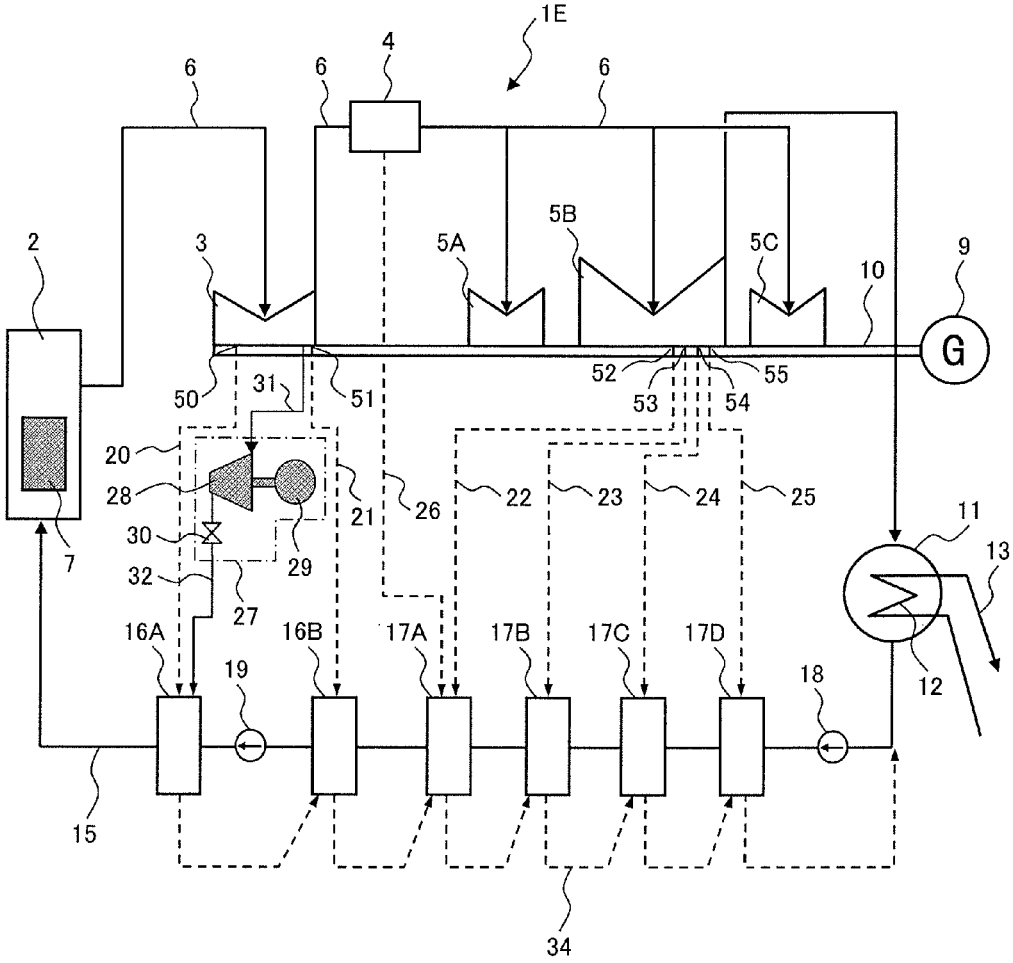
FIG. 9 is a structural diagram showing a power plant according to embodiment 6, which is another embodiment of the present invention, applied to a boiling water nuclear power plant.

A power plant according to embodiment 6, which is another embodiment of the present invention, will be described with reference to FIG. 9. The power plant according to the present embodiment is a BWR-5 type boiling water nuclear power plant 1E generating an electric power of 1100 MWe.

The boiling water nuclear power plant 1E according to the present embodiment has the structure of the boiling water nuclear power plant 1 in embodiment 1 except that the steam compression apparatus (steam heat pump) 27 is connected to the extraction point 51 of the high-pressure turbine 3 and the first high-pressure feed water heater 16A. The other structures of the boiling water nuclear power plant 1E are the same as the boiling water nuclear power plant 1. The steam supply pipe 31 connects the steam inlet of the steam compressor 28 and the extraction point 50 of the high-pressure turbine 3. The steam supply pipe 32 connects the steam outlet of the steam compressor 28 and the first high-pressure feed water heater 16A. The extraction point 51 connected to the steam pipe 31 is located downstream from the extraction point 50 where the extraction pipe 20 is connected to the high-pressure turbine 3. The extraction point 51 connected with the extraction pipe 21 and the extraction point 51 connected with the steam supply pipe 31 are located downstream of the rotor blades disposed in the most downstream side of the high-pressure turbine 3, and are away from each other in the circumferential direction of the high-pressure turbine 3. The steam supply pipe 31 may be connected to the extraction pipe 21.

TABLE 6

| | | | Feed water heater to which compressed steam is supplied | | | | | |
|---|---|---|---|---|---|---|---|---|
| | | State quantity of steam to be compressed. | First high-pressure feed water heater | Second high-pressure feed water heater | Third low-pressure feed water heater | Fourth low-pressure feed water heater | Fifth low-pressure feed water heater | Sixth low-pressure feed water heater |
| Temperature | ° C. | 195 | 220 | — | — | — | — | — |
| Pressure | MPa | 1.5 | 2.4 | — | — | — | — | — |
| Enthalpy | kJ/kg | 2790 | 2800 | — | — | — | — | — |
| Required pressure ratio | | | 1.6 | — | — | — | — | — |
| COP | | | 13.6 | — | — | — | — | — |
| Evaluation | | | ○ | — | — | — | — | — |

During the operation of the boiling water nuclear power plant 1E, the steam extracted from the extraction point 51 of the high-pressure turbine 3 is compressed by the steam compressor 28 and supplied to the first high-pressure feed water heater 16A. The extraction steam extracted from the extraction point 50 of the high-pressure turbine 3 is supplied to the first high-pressure feed water heater 16A through the extraction pipe 20. The steam extracted from the extraction point 51 of the high-pressure turbine 3 and supplied to the steam compressor 28 is a temperature of 195° C. and a pressure of 1.5 MPa, as shown in Table 6. The steam compressed by the steam compressor 28 and supplied to the first high-pressure feed water heater 16A has a temperature of 220° C. and a pressure of 2.4 MPa (see Table 6).

In the present embodiment, the steam compression apparatus 27 is provided so as to compress the steam extracted from the extraction point 51 of the high-pressure turbine 3 and to supply the compressed steam to the first high-pressure feed water heater 16A, thus the coefficient of performance COP of the steam compression apparatus 27 becomes 13.6, as shown in Table 6, satisfying COP>3. Therefore, in the present embodiment, the steam discharged from the extraction point 51 of the high-pressure turbine 3, having a lower energy than the steam extracted from the extraction point 50 of the high-pressure turbine 3 through the extraction pipe 20 and supplied to the first high-pressure feed water heater 16A, can be converted by the steam compression apparatus 27 into the compressed steam having a higher energy to be used for heating the feed water, thus the thermal efficiency of the boiling water nuclear power plant 1E can be further improved.

The present embodiment can obtain each effect generated in the embodiment 1. The present embodiment can improve the thermal efficiency of the boiling water nuclear power plant more than the embodiment 5.

Embodiment 7

Figure 10:
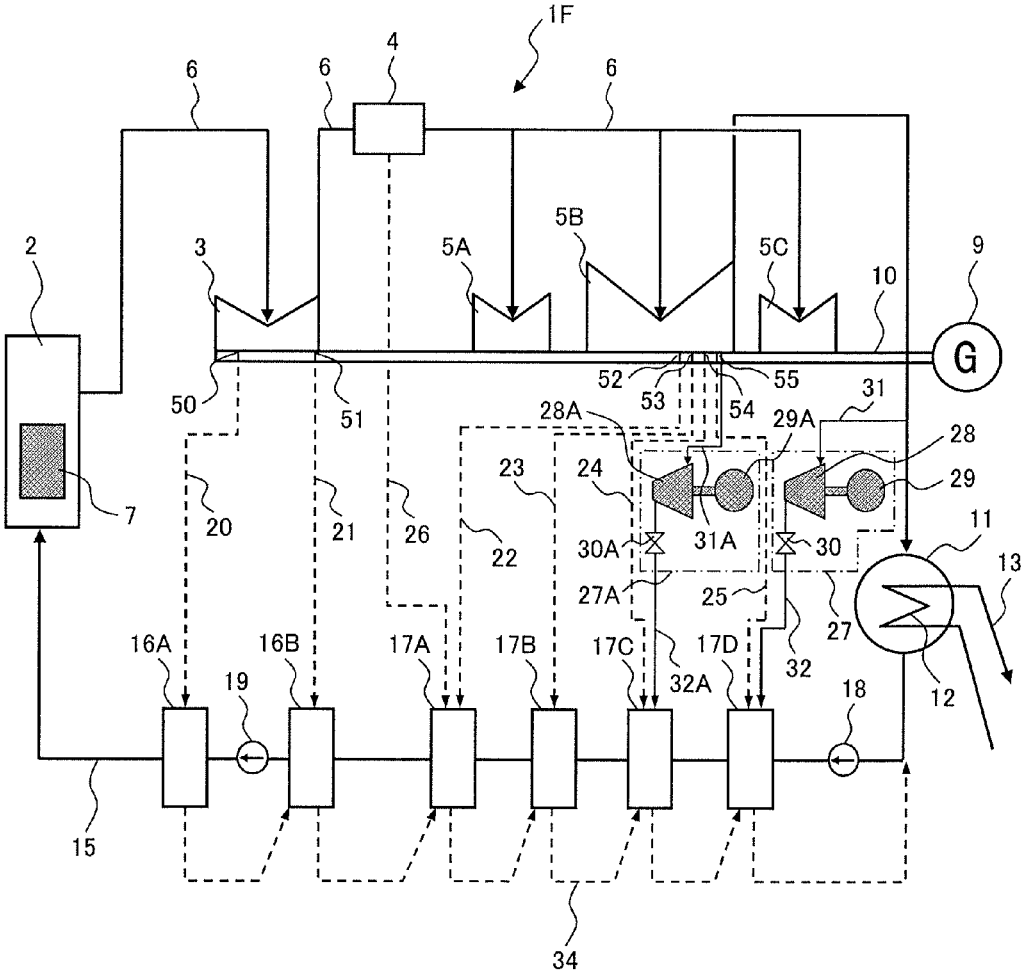
FIG. 10 is a structural diagram showing a power plant according to embodiment 7, which is another embodiment of the present invention, applied to a boiling water nuclear power plant.

A power plant according to embodiment 7, which is another embodiment of the present invention, will be described with reference to FIG. 10. The power plant according to the present embodiment is a BWR-5 type boiling water nuclear power plant 1F generating an electric power of 1100 MWe.

The boiling water nuclear power plant 1F according to the present embodiment has the structure of the boiling water nuclear power plant 1 in the embodiment 1 with the addition of a steam compression apparatus (steam heat pump) 27A. The other structures of the boiling water nuclear power plant 1F are the same as the boiling water nuclear power plant 1. The boiling water nuclear power plant 1F has the steam compression apparatuses 27 and 27A.

The steam compression apparatus 27A has a steam compressor 28A, a driving apparatus (for example, a motor) 29A, and a control valve 30A. The driving apparatus 29A is linked to the rotating shaft of the steam compressor 28A. A steam supply pipe 31A connects the steam inlet of the steam compressor 28A and the extraction point 55 of the low-pressure turbine 5B. A steam supply pipe 32 connects the steam outlet of the steam compressor 28A and the fifth low-pressure feed water heater 17C connected with the extraction pipe 24. The extraction point 55 connected with the extraction pipe 25 and the extraction point 55 connected with the steam supply pipe 31A are located at positions that are in a same stage of stationary blade of the low-pressure turbine 5B and away from each other in the circumferential direction of the low-pressure turbine 5B. The steam compression apparatuses 27A correspondingly provided to the low-pressure turbines 5A and 5C, also, are connected to the fifth low-pressure feed water heaters 17C corresponding to the low-pressure turbines 5A and 5C in the same manner.

During the operation of the boiling water nuclear power plant 1F, the steam extracted from the extraction point 55 of the low-pressure turbine 5B (temperature: 75° C., pressure: 0.04 MPa) is compressed by the steam compressor 28A and supplied to the fifth low-pressure feed water heater 17C to which the extraction steam is supplied through the extraction pipe 24. The compressed steam compressed by the steam compressor 28A and supplied to the fifth low-pressure feed water heater 17C is a temperature of 105° C. and a pressure of 0.12 MPa (see Table 2). The steam compressed by the steam compressor 28 is supplied to the sixth low-pressure feed water heater 17D to which the extraction steam is supplied through the extraction pipe 25.

The present embodiment can obtain each effect generated in the embodiment 1. The present embodiment has two steam compression apparatuses 27 and 27A. Therefore, as shown in FIG. 3, the pressure of the steam discharged from the steam compressor can be adjusted lower than the pressure of the extraction steam to reduce a difference in the temperatures of the heating fluid and the heated fluid compared to a conventional example, so that using two steam compression apparatuses 27 and 27A can reduce a loss during heat exchange in both of the sixth low-pressure feed water heater 17D and the fifth low-pressure feed water heater 17C. Thus, a greater increase in the thermal efficiency can be obtained more than when only one steam compression apparatus 27 is used.

Embodiment 8

Figure 11:
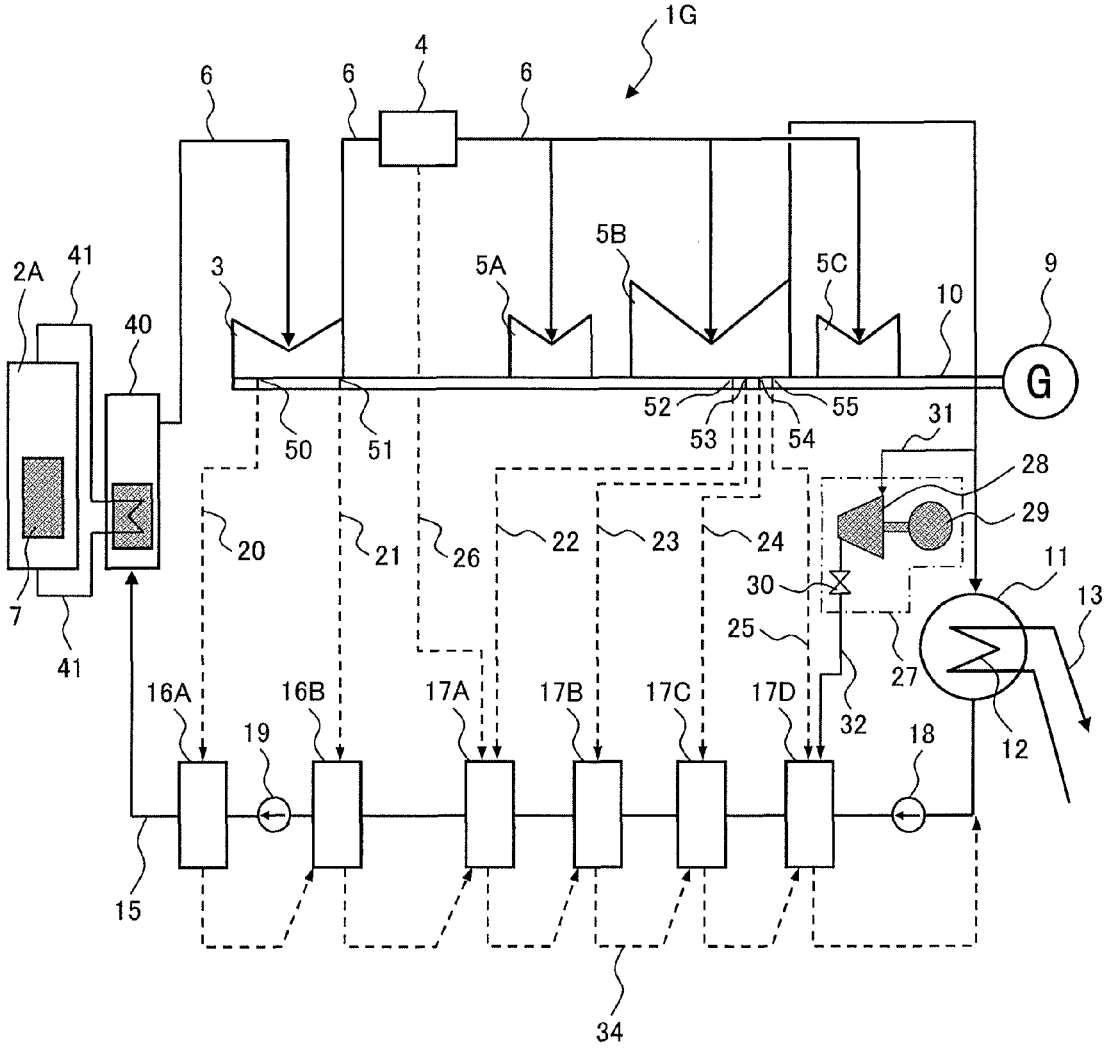
FIG. 11 is a structural diagram showing a power plant according to embodiment 8, which is another embodiment of the present invention, applied to a pressurized water nuclear power plant.

A power plant according to embodiment 8, which is another embodiment of the present invention, will be described with reference to FIG. 11. While each embodiment described above is for a boiling water nuclear power plant, which is a nuclear power plant, the present embodiment is for a pressurized water nuclear power plant, which is a nuclear power plant. Structures of the main steam system and feed water system in a pressurized water nuclear power plant 1G according to the present embodiment are the same as those in the boiling water nuclear power plant 1 in the embodiment 1. In the upstream side of the second high-pressure feed water heater 16B, the feed water pipe 15 provided with the sixth low-pressure feed water heater 17D, the fifth low-pressure feed water heater 17C, the fourth low-pressure feed water heater 17B, the third low-pressure feed water heater 17A, and the condensate pump 18, and the condenser 11 are provided for each of the low-pressure turbines 5A, 5B, and 5C in the same manner as in the embodiment 1. The pressurized water nuclear power plant 1G has the structure of the boiling water nuclear power plant 1 except that the reactor 2, which is the steam generation apparatus, is replaced with a steam generator (a steam generation apparatus) 40, and a reactor 2A and a primary cooling system pipe 41 are additionally installed.

The steam generator 40 is connected to the reactor 2A through the primary cooling system pipe 41 forming a circulation loop for cooling water. A circulation pump (not shown) is provided to the primary cooling system pipe 41. The main steam pipe 6 and the feed water pipe 15 are connected to the steam generator 40. The primary cooling system pipe 41 communicates with a plurality of heat exchanger tubes (not shown) provided in the steam generator 40, and the main steam pipe 6 and the feed water pipe 15 communicate with a region in a shell of the steam generator 40.

The high-temperature cooling water heated in the core 7 of the reactor 2A is supplied into the heat exchanger tubes of the steam generator 40 through the primary cooling system pipe 41 by the operation of the circulation pump. This high-temperature cooling water heats the feed water supplied into a shell of the steam generator 40. The feed water is supplied from the feed water pipe 15 and becomes steam by being heated by the high-temperature cooling water. The cooling water whose temperature has been decreased by heating the feed water returns to the reactor 2A through the primary cooling system pipe 41.

The steam generated in the steam generator 40 is supplied to the high-pressure turbine 3 and low-pressure turbines 5A, 5B, and 5C through the main steam pipe 6 in the same manner as in the boiling water nuclear power plant 1. The steam discharged from the low-pressure turbine is condensed in the condenser 11 to become water. This water passes through the feed water pipe 15, in the same manner as in the boiling water nuclear power plant 1, is sequentially heated by each feed water heater to increase its temperature, and is supplied to the steam generator 40 at a set temperature as feed water.

In the present embodiment also, the steam discharged from the low-pressure turbine is compressed by the steam compressor 28 in the same manner as in the embodiment 1, and supplied to the sixth low-pressure feed water heater 17D to which the extraction steam is introduced through the extraction pipe 25.

The present embodiment can also obtain each effect generated in the embodiment 1.

Instead of the connecting state of the steam generation apparatus 27 in the present embodiment, each connecting state of the steam generation apparatus 27 described in the embodiments 2 to 6 may be applied to the pressurized water nuclear power plant 1G. Furthermore, the steam compression apparatus 27A may be added to the pressurized water nuclear power plant 1G in the same manner as in the embodiment 7.

Embodiment 9

Figure 12:
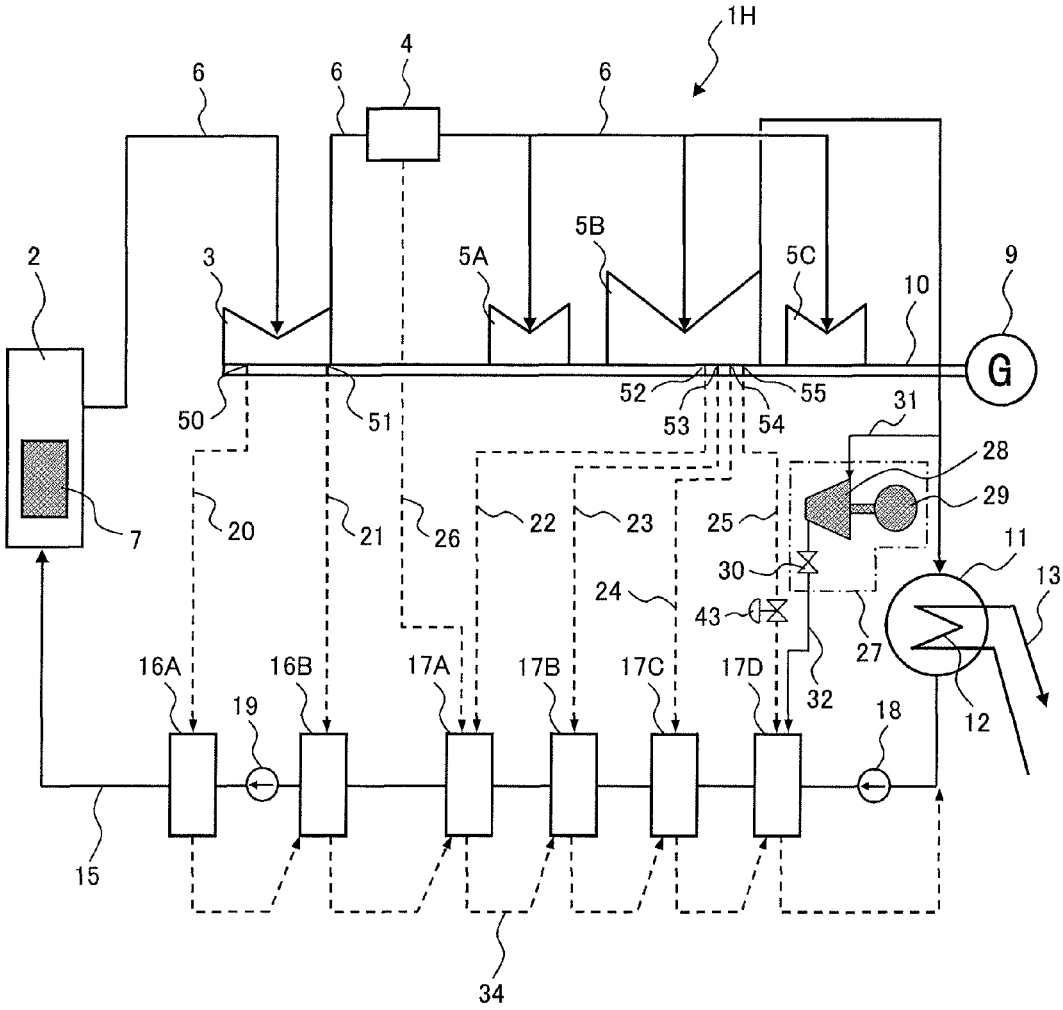
FIG. 12 is a structural diagram showing a power plant according to embodiment 9, which is another embodiment of the present invention, applied to a boiling water nuclear power plant.

A power plant according to embodiment 9, which is another embodiment of the present invention, will be described with reference to FIG. 12. The power plant according to the present embodiment is a BWR-5 type boiling water nuclear power plant 1H generating an electric power of 1100 MWe.

The boiling water nuclear power plant 1H according to the present embodiment has the structure of the boiling water nuclear power plant 1 in the embodiment 1 with the addition of a flow rate adjusting valve 43. The other structures of the boiling water nuclear power plant 1F are the same as the boiling water nuclear power plant 1. The flow rate adjusting valve 43 is provided to the extraction pipe 25 connected to the sixth low-pressure feed water heater 17D connected to the steam compressor 28. This extraction pipe 25 is connected to the extraction point 55 of the low-pressure turbine 5B. To be more specific, the flow rate adjusting valve 43 is provided to each of the extraction pipes 25 correspondingly provided to the low-pressure turbines 5A, 5B, and 5C.

In the present embodiment also, in the same manner as in the embodiment 1, the steam discharged from the low-pressure turbine 5B is compressed by the steam compressor 28 and supplied to the sixth low-pressure feed water heater 17D. The flow rate of the compressed steam supplied from the steam compressor 28 to the sixth low-pressure feed water heater 17D is maintained at a set flow rate throughout the operation period of the boiling water nuclear power plant 1H.

The steam compressed by the steam compressor 28 is supplied to the sixth low-pressure feed water heater 17D to which the extraction steam is introduced through the extraction pipe 25, so that the flow rate of the steam as a heat source supplied to the sixth low-pressure feed water heater 17D is increased more than the flow rate of the steam supplied to the sixth low-pressure feed water heater in the conventional boiling water nuclear power plant without the steam compression apparatus 27. In the boiling water nuclear power plant 1H, when the flow rate of the steam supplied to the sixth low-pressure feed water heater 17D is increased more than that in the conventional boiling water nuclear power plant, the flow rate of the extraction steam supplied to each feed water heater located downstream from the sixth low-pressure feed water heater 17D must be adjusted to be less. However, the present embodiment is provided with the flow rate adjusting valve 43 in the extraction pipe 25 connected to the sixth low-pressure feed water heater 17D to which the compressed steam is introduced, so that degree of an opening of the flow rate adjusting valve 43 can be reduced and the flow rate of the extraction steam supplied from the low-pressure turbine 5C to the sixth low-pressure feed water heater 17D is decreased. Therefore, it is practically unnecessary to adjust the flow rate of the extraction steam supplied to each feed water heater located downstream from the sixth low-pressure feed water heater 17D. The present embodiment makes the adjustment of the flow rate of the extraction steam easier. The degree of the opening of the flow rate adjusting valve 43 is adjusted before the boiling water nuclear power plant 1H is started. Once the boiling water nuclear power plant 1H is started, practically, the degree of the opening of the flow rate adjusting valve 43 cannot be adjusted except for performing fine adjustments on the flow rate of the extraction steam described above.

The flow rate adjusting valve 43 provided to the extraction pipe 25 connected to the extraction point 55 of the low-pressure turbine 5A and the flow rate adjusting valve 43 provided to the extraction pipe 25 connected to the extraction point 55 of the low-pressure turbine 5C can be adjusted in the same manner.

The present embodiment provided with the steam compression apparatus 27 can obtain each effect generated in the embodiment 1. In the present embodiment, the flow rate adjusting valve 43 is provided to the extraction pipe 25, so that it is practically unnecessary to adjust the flow rate of the extraction steam supplied through the extraction pipes other than the extraction pipe 25 provided with the flow rate adjusting valve 43. Furthermore, since the flow rate of the extraction steam to the sixth low-pressure feed water heater 17D to which the compressed steam is supplied can be decreased by reducing the degree of the opening of the flow rate adjusting valve 43, the thermal efficiency of the boiling water nuclear power plant 1H can be further improved.

A reason for the thermal efficiency of the power plant to be increased by adjusting the flow rate adjusting valve 43 will be described below. It is assumed here that the steam compressor 28 is connected to the extraction point 55 of the low-pressure turbine 5B through the steam supply pipe 31 and to the fifth low-pressure feed water heater 17C through the steam supply pipe 32.

The fifth low-pressure feed water heater 17C is supplied with the extraction steam at 105° C. from the extraction point 54 through the extraction pipe 24. The feed water supplied to the fifth low-pressure feed water heater 17C is heated to 98° C. by this extraction steam. Now, the compressed steam at 120° C. is assumed to be supplied from the steam compressor 28 to the fifth low-pressure feed water heater 17C. In the conventional boiling water nuclear power plant, the feed water could be heated only up to 98° C. in the fifth low-pressure feed water heater. In the boiling water nuclear power plant 1H, however, the above-mentioned compressed steam at 120° C. can be supplied from the steam compressor 28 to the fifth low-pressure feed water heater 17C, so that the feed water can be heated, for example, to 110° C. in the fifth low-pressure feed water heater 17C. The fourth low-pressure feed water heater 17B has a function of increasing the feed water temperature from 98° C. to 126° C. by using the extraction steam at 130° C. supplied through the extraction pipe 23. Supplying the compressed steam from the steam compressor 28 to the fifth low-pressure feed water heater 17C as described above allows part of the function of the fourth low-pressure feed water heater 17B to be performed in the fifth low-pressure feed water heater 17C. Therefore, in the fourth low-pressure feed water heater 17B, the temperature of the feed water is only increased from 110° C. to 126° C. That is, the rate of the extraction steam extracted from the extraction point 53 of the low-pressure turbine 5B can be decreased.

In the conventional example, the fourth low-pressure feed water heater uses the extraction steam at 130° C. to heat the feed water from 98° C. to 110° C. and further to 126° C. This is because the temperature and the pressure of the extraction steam correspond to those between the stages of the low-pressure turbine. Thus, the extraction steam at a pressure and a temperature of in-between values cannot be supplied to the feed water heater in the conventional power plant. In consideration of heating the feed water to 110° C. only, from a viewpoint of the effective usage of energy, a temperature of 120° C. is enough for the compressed steam supplied from the steam compressor 28 to the fifth low-pressure feed water heater 17C.

Consequently, in the present embodiment, the flow rate of the extraction steam at 130° C. supplied through the extraction pipe 23 can be decreased. Since the decreased flow rate portion of the extraction steam can be recovered as power in the low-pressure turbine, the efficiency of the plant is increased.

Additionally, a situation will be described where the extraction steam supplied to the fourth low-pressure feed water heater 17B through the extraction pipe 23 is supplied without being decreased in its flow rate while the compressed steam is supplied from the steam compressor 28 to the fifth low-pressure feed water heater 17C. The temperature of the feed water in the fourth low-pressure feed water heater 17B cannot exceed the temperature of the extraction steam in the heating side even when the use conditions of fourth low-pressure feed water heater have been slightly changed from the conventional ones. Consequently, the temperature of the feed water heated by the extraction steam at 130° C. will be increased only slightly (1 to 2° C.) from 126° C., not effectively utilizing the thermal energy of the extraction steam. In a group of feed water heaters for increasing the temperature of feed water in stages, it is important that the steam for heating is supplied in consideration of the overall balance in temperature. The use of the steam compression apparatus (heat pump) 27 allows the temperature of the heating steam to be adjusted, thus the efficiency of the power plant can be improved.

In each embodiment of the previously described embodiments 2 to 8 also, the flow rate adjusting valve 43 may be provided to the extraction pipe connected to the feed water heater to which the steam compressed by the steam compressor 28 is supplied.

REFERENCE SIGNS LIST

1, 1A, 1B, 1C, 1D, 1E, 1F, 1H: boiling water nuclear power plant, 1G: pressurized water nuclear power plant, 2, 2A: reactor, 3: high-pressure turbine, 4: moisture separator, 5A, 5B, 5C: low-pressure turbine, 6: main steam pipe, 11: condenser, 15: feed water pipe, 16A: first high-pressure feed water heater, 16B: second high-pressure feed water heater, 17A: third low-pressure feed water heater, 17B: fourth low-pressure feed water heater, 17C fifth low-pressure feed water heater, 17D: sixth low-pressure feed water heater, 19: feed water pump, 20, 21, 22, 23, 24, 25: extraction pipe, 26: drainpipe, 27, 27A: steam compression apparatus, 28, 28A, 28B: steam compressor, 29, 29A driving apparatus, 40: steam generator, 43: flow rate adjusting valve, 50, 51, 52, 53, 54, 55: extraction point.

What is claimed is:

1. A power plant having a steam generation apparatus for generating steam comprising:

a main steam system having a main steam pipe for introducing steam connected to the steam generation apparatus, and a first turbine and a second turbine having a lower pressure than the first turbine to which turbines, the steam is sequentially supplied through the main steam pipe;

a condenser for condensing the steam discharged from the second turbine;

a feed water pipe for introducing feed water generated by condensing the steam in the condenser to the steam generation apparatus;

a plurality of feed water heaters provided on the feed water pipe;

a steam compression apparatus for compressing the steam;

a first pipe, not provided with the steam compression apparatus, for introducing the steam extracted from a first position of the main steam system to one of the feed water heaters; and a second pipe, provided with the steam compression apparatus, for connecting a second position of the main steam system located downstream of the first position to a feed water heater that is directly connected with the first pipe, wherein, the second pipe is directly connected to the feed water heater that is directly connected to the first pipe; and when power required by the steam compression apparatus for compressing the steam is Q1, a heat quantity supplied to one of the feed water heaters by the steam compressed by the steam compression apparatus is Q3, a coefficient of performance of the steam compression apparatus, defined as Q3/Q1, is COP, and thermal efficiency of the power plant supplying the power Q1 to the steam compression apparatus is $\eta$, the second pipe provided with the steam compression apparatus is connected to the second position and one of the feed water heaters so as to satisfy $COP-1/\eta>0$.

2. The power plant according to claim 1, wherein a flow rate adjusting valve is provided on the first pipe.

3. The power plant according to claim 1 wherein the plurality of feed water heaters include a first feed water heater, a second feed water heater, a third feed water heater, a fourth feed water heater, a fifth feed water heater, and a sixth feed water heater;

the first feed water heater, the second feed water heater, the third feed water heater, the fourth feed water heater, the fifth feed water heater, and the sixth feed water heater are installed on the feed water pipe in this order from downstream to upstream;

six extraction positions distinct in the direction of steam flow in the main steam system are formed in the main steam system, respectively;

six extraction pipes for separately and respectively supplying the steam separately extracted from the six extraction positions are connected to the corresponding feed water heaters, respectively;

the first position is the extraction position connected to the extraction pipe, which is the first pipe, connected to either the fifth feed water heater or the sixth feed water heater;

the second position is located downstream of the second turbine;

a steam supply pipe, which is the second pipe, is connected to the second position and either the fifth feed water heater or the sixth feed water heater; and wherein the steam compression apparatus for compressing the steam discharged from the second turbine is installed on the steam supply pipe.

4. The power plant according to claim 1 wherein the plurality of feed water heaters include a first feed water heater, a second feed water heater, a third feed water heater, a fourth feed water heater, a fifth feed water heater, and a sixth feed water heater;

the first feed water heater, the second feed water heater, the third feed water heater, the fourth feed water heater, the fifth feed water heater, and the sixth feed water heater are installed on the feed water pipe in this order from downstream to upstream;

two extraction positions distinct in the axial direction of the first turbine are formed in the first turbine, respectively and four extraction positions distinct in the axial direction of the second turbine are formed in the second turbine, respectively;

six extraction pipes for separately and respectively supplying the steam separately extracted from the two extraction positions in the first turbine and from the four extraction positions in the second turbine to the corresponding feed water heaters, respectively;

the first position is the extraction position connected to the extraction pipe, which is the first pipe, connected to one of the third feed water heater, the fourth feed water heater, and the fifth feed water heater;

the second position is either the extraction position positioned in the most downstream side of the four extraction positions provided on the second turbine or an extraction position positioned away from the extraction position in the circumferential direction of the second turbine;

a steam supply pipe, which is the second pipe, is connected to the second position and one of the third feed water heater, the fourth feed water heater, and the fifth feed water heater; and the steam compression apparatus for compressing the steam extracted either from the extraction position positioned in the most downstream side of the four extraction positions or from the extraction position positioned away from the extraction position in the circumferential direction is installed on the steam supply pipe.

5. The power plant according to claim 1 wherein the plurality of feed water heaters include a first feed water heater, a second feed water heater, a third feed water heater, a fourth feed water heater, a fifth feed water heater, and a sixth feed water heater;

the first feed water heater, the second feed water heater, the third feed water heater, the fourth feed water heater, the fifth feed water heater and the sixth feed water heater are installed on the feed water pipe in this order from downstream to upstream;

two extraction positions distinct in the axial direction of the first turbine are formed in the first turbine, respectively and four extraction positions distinct in the axial direction of the second turbine are formed in the second turbine, respectively:

six extraction pipes for separately and respectively supplying the steam separately extracted from the two extraction positions in the first turbine and from the four extraction positions in the second turbine to the corresponding feed water heaters, respectively;

the first position is the extraction position connected to the extraction pipe, which is the first pipe, connected to one of the second feed water heater, the third feed water heater, and the fourth feed water heater;

the second position is either the extraction position positioned third from an upstream side of the four extraction positions provided on the second turbine or an extraction position positioned away from the extraction position in the circumferential direction of the second turbine;

a steam supply pipe, which is the second pipe, is connected to the second position and one of the second feed water heater, the third feed water heater, and the fourth feed water heater; and the steam compression apparatus for compressing the steam extracted either from the extraction position positioned third from an upstream side of the four extraction positions or from an extraction position positioned away from the extraction position in the circumferential direction is installed on the steam supply pipe.

6. The power plant according to claim 1 wherein the plurality of feed water heaters include a first feed water heater, a second feed water heater, a third feed water heater, a fourth feed water heater, a fifth feed water heater, and a sixth feed water heater;

the first feed water heater, the second feed water heater, the third feed water heater, the fourth feed water heater, the fifth feed water heater, and the sixth feed water heater are installed on the feed water pipe in this order from downstream to upstream;

two extraction positions distinct in the axial direction of the first turbine are formed in the first turbine, respectively and four extraction positions distinct in the axial direction of the second turbine are formed in the second turbine, respectively;

six extraction pipes for separately and respectively supplying the steam separately extracted from the two extraction positions in the first turbine and from the four extraction positions in the second turbine to the corresponding feed water heaters, respectively;

the first position is the extraction position connected to the extraction pipe, which is the first pipe, connected to one of the first feed water heater, the second feed water heater, and the third feed water heater;

the second position is either the extraction position positioned second from an upstream side of the four extraction positions provided on the second turbine or an extraction position positioned away from the extraction position in the circumferential direction of the second turbine;

a steam supply pipe, which is the second pipe, is connected to the second position and one of the first feed water heater, the second feed water heater, and the third feed water heater; and the steam compression apparatus for compressing the steam extracted either from the extraction position positioned second from an upstream side of the four extraction positions or from an extraction position positioned away from the extraction position in the circumferential direction is installed on the steam supply pipe.

7. The power plant according to claim 1 wherein the plurality of feed water heaters include a first feed water heater, a second feed water heater, a third feed water heater, a fourth feed water heater, a fifth feed water heater, and a sixth feed water heater;

the first feed water heater, the second feed water heater, the third feed water heater, the fourth feed water heater, the fifth feed water heater, and the sixth feed water heater are installed on the feed water pipe in this order from downstream to upstream;

two extraction positions distinct in the axial direction of the first turbine are formed in the first turbine, respectively and four extraction positions distinct in the axial direction of the second turbine are formed in the second turbine, respectively;

six extraction pipes for separately and respectively supplying the steam separately extracted from the two extraction positions in the first turbine and from the four extraction positions in the second turbine to the corresponding feed water heaters, respectively;

the first position is the extraction position connected to the extraction pipe, which is the first pipe, connected to either the first feed water heater or the second feed water heater;

the second position is either the extraction position positioned in the most upstream side of the four extraction positions provided on the second turbine or an extraction position positioned away from the extraction position in the circumferential direction of the second turbine;

a steam supply pipe, which is the second pipe, is connected to the second position and either the first feed water heater or the second feed water heater; and the steam compression apparatus for compressing the steam extracted either from the extraction position positioned in the most upstream side of the four extraction positions or from an extraction position positioned away from the extraction position in the circumferential direction is installed on the steam supply pipe.

8. The power plant according to claim 1 wherein the plurality of feed water heaters include a first feed water heater, a second feed water heater, a third feed water heater, a fourth feed water heater, a fifth feed water heater, and a sixth feed water heater;

the first feed water heater, the second feed water heater, the third feed water heater, the fourth feed water heater, the fifth feed water heater, and the sixth feed water heater are installed on the feed water pipe in this order from downstream to upstream;

two extraction positions distinct in the axial direction of the first turbine are formed in the first turbine, respectively and four extraction positions distinct in the axial direction of the second turbine are formed in the second turbine, respectively;

six extraction pipes for separately and respectively supplying the steam separately extracted from the two extraction positions in the first turbine and from the four extraction positions in the second turbine to the corresponding feed water heaters, respectively;

the first position is the extraction position connected to the extraction pipe, which is the first pipe, connected to the first feed water heater;

the second position is either the extraction position positioned in the most downstream side of the two extraction positions provided on the first turbine or an extraction position positioned away from the extraction position in the circumferential direction of the second turbine;

a steam supply pipe, which is the second pipe, is connected to the second position and the first feed water heater; and the steam compression apparatus for compressing the steam extracted either from the extraction position positioned in the most downstream side of the two extraction positions or from an extraction position positioned away from the extraction position in the circumferential direction is installed on the steam supply pipe.

9. The power plant according to claim 3, wherein a flow rate adjusting valve is provided on the extraction pipe connected to the feed water heater connected to the steam supply pipe.

10. The power plant according to claim 4 wherein a flow rate adjusting valve is provided on the extraction pipe connected to the feed water heater connected to the steam supply pipe.

11. The power plant according to claim 5 wherein a flow rate adjusting valve is provided on the extraction pipe connected to the feed water heater connected to the steam supply pipe.

12. The power plant according to claim 6 wherein a flow rate adjusting valve is provided on the extraction pipe connected to the feed water heater connected to the steam supply pipe.

13. The power plant according to claim 7 wherein a flow rate adjusting valve is provided on the extraction pipe connected to the feed water heater connected to the steam supply pipe.

14. The power plant according to claim 8 wherein a flow rate adjusting valve is provided on the extraction pipe connected to the feed water heater connected to the steam supply pipe.

* * * * *